US008590949B2

(12) United States Patent
Wang

(10) Patent No.: US 8,590,949 B2
(45) Date of Patent: Nov. 26, 2013

(54) DURABLE CYLINDRICAL LOCK

(75) Inventor: Bill Wang, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 119 days.

(21) Appl. No.: 13/409,412

(22) Filed: Mar. 1, 2012

(65) Prior Publication Data

US 2013/0229021 A1 Sep. 5, 2013

(51) Int. Cl.
*E06B 3/00* (2006.01)

(52) U.S. Cl.
USPC ..... 292/336.3

(58) Field of Classification Search
USPC ..... 292/247, 348, 336, 3
See application file for complete search history.

(56) References Cited

U.S. PATENT DOCUMENTS 6,705,138 B1 * 3/2004 Shen ..... 70/224
6,979,029 B2 * 12/2005 Shen ..... 292/336.3
7,082,794 B2 * 8/2006 Shen et al. ..... 70/224
7,143,477 B2 * 12/2006 Dalsing et al. ..... 16/412
7,793,527 B2 * 9/2010 Shen ..... 70/224
7,934,754 B2 * 5/2011 Mathachan ..... 292/347
8,360,489 B2 * 1/2013 Cho ..... 292/357

* cited by examiner

*Primary Examiner* — Carlos Lugo
*Assistant Examiner* — Mark Williams
(74) *Attorney, Agent, or Firm* — Alan Kamrath; Kamrath IP Lawfirm, P.A.

(57) ABSTRACT

A cylindrical lock includes a retractor (131) mounted between inner and outer operational devices (10, 12) and operably connected to a latch (779). The inner operational device (10) includes an inner chassis (20), an inner spindle (76), and an inner lining (60) made of a material harder than the inner spindle (76). The outer operational device (12) includes an outer chassis (305), an outer spindle (379), and an outer lining (353) made of a material harder than the outer spindle (379). Inner and outer returning devices (38A, 38B) are provided for returning the inner and outer spindles (76, 379). A torsion spring (50A, 50B) of each of the inner and outer returning devices (38A, 38B) is mounted to a push ring (40A, 40B) before assembly with the inner and outer chassis (20, 305), allowing easy assembly of the torsion springs (50A, 50B).

6 Claims, 16 Drawing Sheets

DURABLE CYLINDRICAL LOCK

BACKGROUND OF THE INVENTION

The present invention relates to a cylindrical lock and, more particularly, to a durable cylindrical lock.

Cylindrical locks on the market generally include inner and outer operational devices that can be operated to retract a latch through a retractor. The inner operational device includes an inner chassis, an inner spindle, and an inner handle. The outer operational device includes an outer chassis, an outer spindle, and an outer handle. Each of the inner and outer handles includes a lug for moving the retractor. To allow pivotal connection with the inner and outer spindles while preventing disengagement of the inner and outer spindles, each of the inner and outer spindles includes a space and an axial hole for pivotally receiving the inner or outer spindle. Furthermore, a torsion spring is mounted in each of the inner and outer chassis for returning the inner or outer spindle. To restrain the pivotal movement of the inner and outer spindles, the space of each of the inner and outer chassis includes an arcuate movement groove having two stepped portions spaced by an angle not larger than 180°, reducing the risk of deformation of the lug. However, the inner and outer chassis are generally made of the same material as the inner and outer spindles. The inner peripheries of the spaces and the axial holes of the inner and outer chassis are liable to wear due to pivotal movement of the inner and outer spindles. Furthermore, two tangs of each torsion spring must be twisted before the torsion springs are mounted in the inner and outer chassis, leading to difficulties in assembly.

Thus, a need exists for a novel cylindrical lock that can avoid wear to the inner and outer chassis while allowing easy assembly.

BRIEF SUMMARY OF THE INVENTION

The present invention solves this need and other problems in the field of durable and easy-to-assemble cylindrical locks by providing a cylindrical lock including an inner chassis having inner and outer ends spaced in a longitudinal direction. A space extends from the inner end of the inner chassis toward but spaced from the outer end of the inner chassis. A rib is formed on an inner periphery of the space. An axial hole extends from the outer end of the inner chassis to the space. The inner chassis is adapted to be mounted in a first mounting hole of a door. The door has inner and outer sides spaced in the longitudinal direction. An inner locking ring is mounted around the inner chassis. The inner locking ring is adapted to abut the inner side of the door. A first push ring is pivotably received in the space of the inner chassis and adjacent to the outer end of the inner chassis. The first push ring includes a sleeve portion having first and second ends spaced in the longitudinal direction. An actuating groove is defined in an outer periphery of the sleeve portion of the first push ring. A first push leg extends from one of the first and second ends of the sleeve portion of the first push ring. The first push leg is spaced from the outer periphery of the sleeve portion of the first push ring in a radial direction perpendicular to the longitudinal direction. A first torsion spring is mounted around the sleeve portion of the first push ring. The first torsion spring includes first and second tangs abutting two sides of the first push leg of the first push ring. The rib of the inner chassis is located between the first and second tangs of the first torsion spring. When the first push ring pivots in the circumferential direction, the first push leg pivots the first tang of the first push ring, and the second tang of the first push ring is retained on the rib of the inner chassis.

The cylindrical lock further includes an inner lining mounted in the space of the inner chassis and made of a material having a hardness of HRB80-HRB100. The inner lining includes first and second sides spaced in the longitudinal direction. A pivot hole is defined in the second side of the inner lining and aligned with the axial hole of the inner chassis. The second side of the inner lining abuts the push ring. An inner spindle is pivotably received in the inner chassis. The inner spindle is made of a material having a hardness of HRC35-HRC50. The inner spindle includes an inner end located in the inner chassis and an outer end located outside of the inner chassis. The inner spindle further includes an outer periphery extending between the inner and outer ends of the inner spindle. A lug is formed on the inner end of the inner spindle and protrudes radially outward away from the outer periphery of the inner spindle. An actuating block protrudes outward from the outer periphery of the inner spindle and is located adjacent to the inner end of the inner spindle. A portion of the inner spindle adjacent to the inner end is pivotably received in the pivot hole of the inner lining. The lug is located outside of the first side of the inner lining. The outer end of the inner spindle is located outside of the outer end of the inner chassis. The actuating block of the inner spindle is engaged with the actuating groove of the first push ring. An inner handle is mounted to the outer end of the inner spindle and located beyond the outer end of the inner chassis. The inner spindle and the push ring pivot together with the inner handle in a circumferential direction about the longitudinal direction when the inner handle pivots in the circumferential direction.

The cylindrical lock further includes an outer chassis having inner and outer ends spaced in the longitudinal direction. A space extends from the inner end of the outer chassis toward but spaced from the outer end of the outer chassis. A rib is formed on an inner periphery of the space of the outer chassis. A axial hole extends from the outer end of the outer chassis to the space of the outer chassis. The outer chassis is adapted to be mounted in the first mounting hole of the door. Two engagement arms extend from the inner end of the outer chassis and are fixed to the inner chassis, with the inner end of the inner chassis spaced from the inner end of the outer chassis.

An outer locking ring is mounted around the outer chassis and adapted to abut the outer side of the door. A second push ring is pivotably received in the space of the outer chassis and adjacent to the outer end of the outer chassis. The second push ring includes a sleeve portion having first and second ends spaced in the longitudinal direction. An actuating groove is defined in an outer periphery of the sleeve portion of the second push ring. A second push leg extends from one of the first and second ends of the sleeve portion of the second push ring. The second push leg is spaced from the outer periphery of the sleeve portion of the second push ring in a radial direction perpendicular to the longitudinal direction. A second torsion spring is mounted around the sleeve portion of the second push ring. The second torsion spring includes first and second tangs abutting two sides of the second push leg. The rib of the outer chassis is located between the first and second tangs of the second torsion spring. When the second push ring pivots in the circumferential direction, the second push leg pivots the first tang of the second push ring, and the second tang of the second push ring is retained on the rib of the outer chassis.

An outer lining is mounted in the space of the outer chassis and made of a material having a hardness of HRB80-HRB100. The outer lining includes first and second sides spaced in the longitudinal direction. A pivot hole is defined in the second side of the outer lining and aligned with the axial hole of the outer chassis. The second side of the outer lining abuts one of the first and second ends of the second push ring. An outer spindle is pivotably received in the outer chassis and made of a material having a hardness of HRC35-HRC50. The outer spindle includes an inner end and an outer end. The outer spindle further includes an outer periphery extending between the inner and outer ends of the outer spindle. An actuating block protrudes outward from the outer periphery of the outer spindle. The outer spindle includes a receiving space extending from the inner end of the outer spindle through the outer end of the outer spindle. The inner end of the outer spindle is pivotably received in the pivot hole of the outer lining. The outer end of the outer spindle is located outside of the outer end of the outer chassis. The actuating block of the outer spindle is engaged with the actuating groove of the second push ring.

An outer handle is mounted to the outer end of the outer spindle and located beyond the outer end of the outer chassis. The outer spindle and the push ring pivot together with the outer handle in the circumferential direction when the outer handle pivots in the circumferential direction. An actuating cylinder is received in the receiving space of the outer spindle. The actuating cylinder includes a tab. The actuating cylinder pivots together with the outer handle when the outer handle pivots in the circumferential direction. A retractor includes two lateral surfaces defining first and second push faces, respectively. The retractor is slideably received between the inner end of the inner chassis and the inner end of the outer chassis. The lug of the inner spindle abuts the second push face. The tab of the actuating cylinder abuts the first push face. The retractor is adapted to be connected to a drawing member of a latch device mounted in a second mounting hole of the door in communication with the first mounting hole. The latch device includes a latch movable between a latching position in the door and an unlatching position outside of the door. The retractor is movable between a first position in which the latch is in the latching position and a second position in which the latch is in the unlatching position.

When the inner handle pivots in the circumferential direction, the lug of the inner spindle presses against the second push face of the retractor, moving the retractor from the first position to the second position.

When the outer handle pivots in the circumferential direction, the outer spindle and the actuating cylinder pivot in the circumferential direction, and the tab of the actuating cylinder presses against the first push face of the retractor, moving the retractor from the first position to the second position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
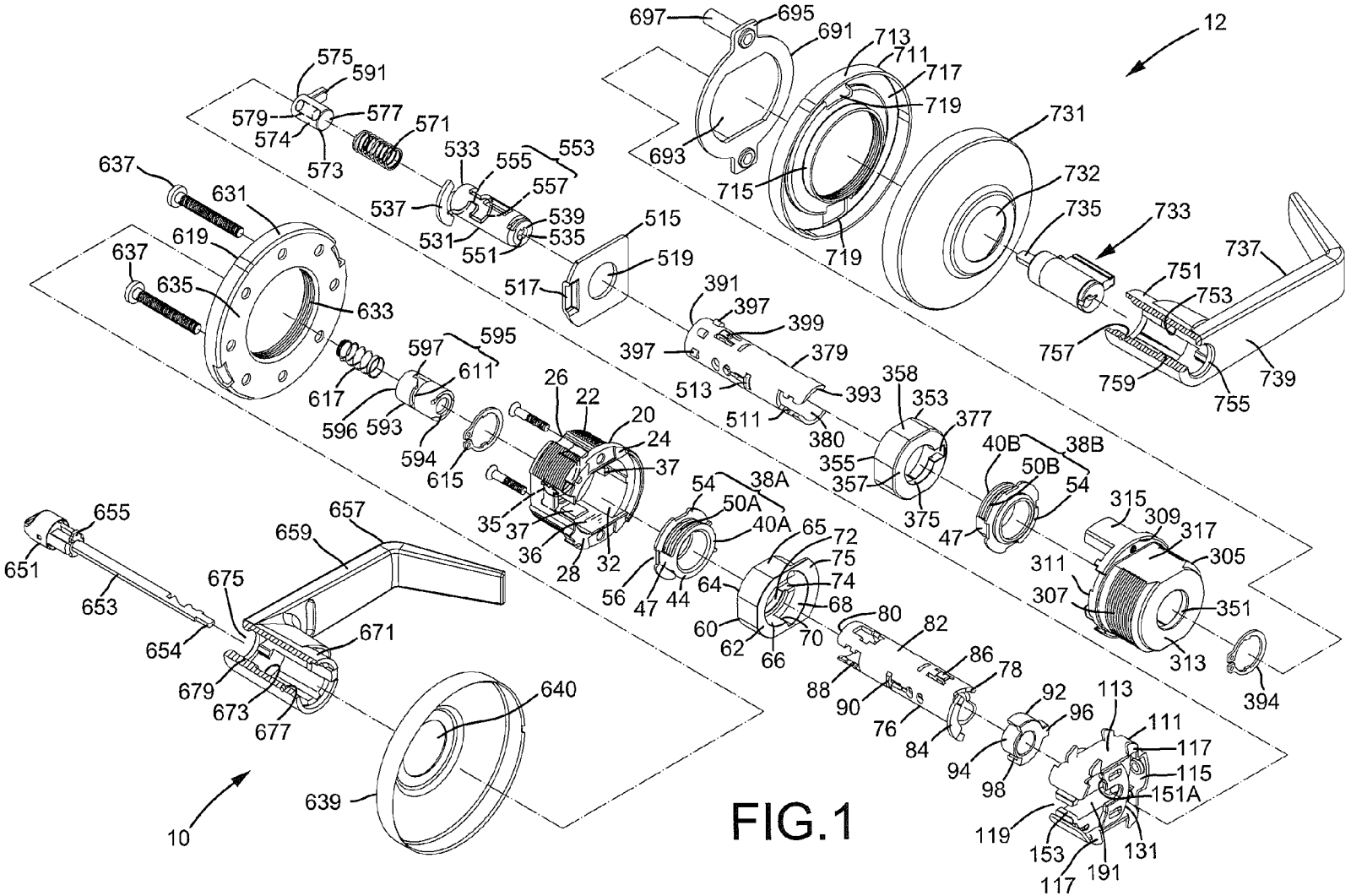
FIG. 1 shows an exploded, perspective view of a cylindrical lock according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "lower", "upper", "top", "bottom", "side", "end", "portion", "section", "longitudinal", "circumferential", "transverse", "radial" "horizontal", "vertical", "spacing", "length", and similar terms are used herein, it should be understood that these terms have reference only to the structure shown in the drawings as it would appear to a person viewing the drawings and are utilized only to facilitate describing the illustrative embodiments.

Figure 6:
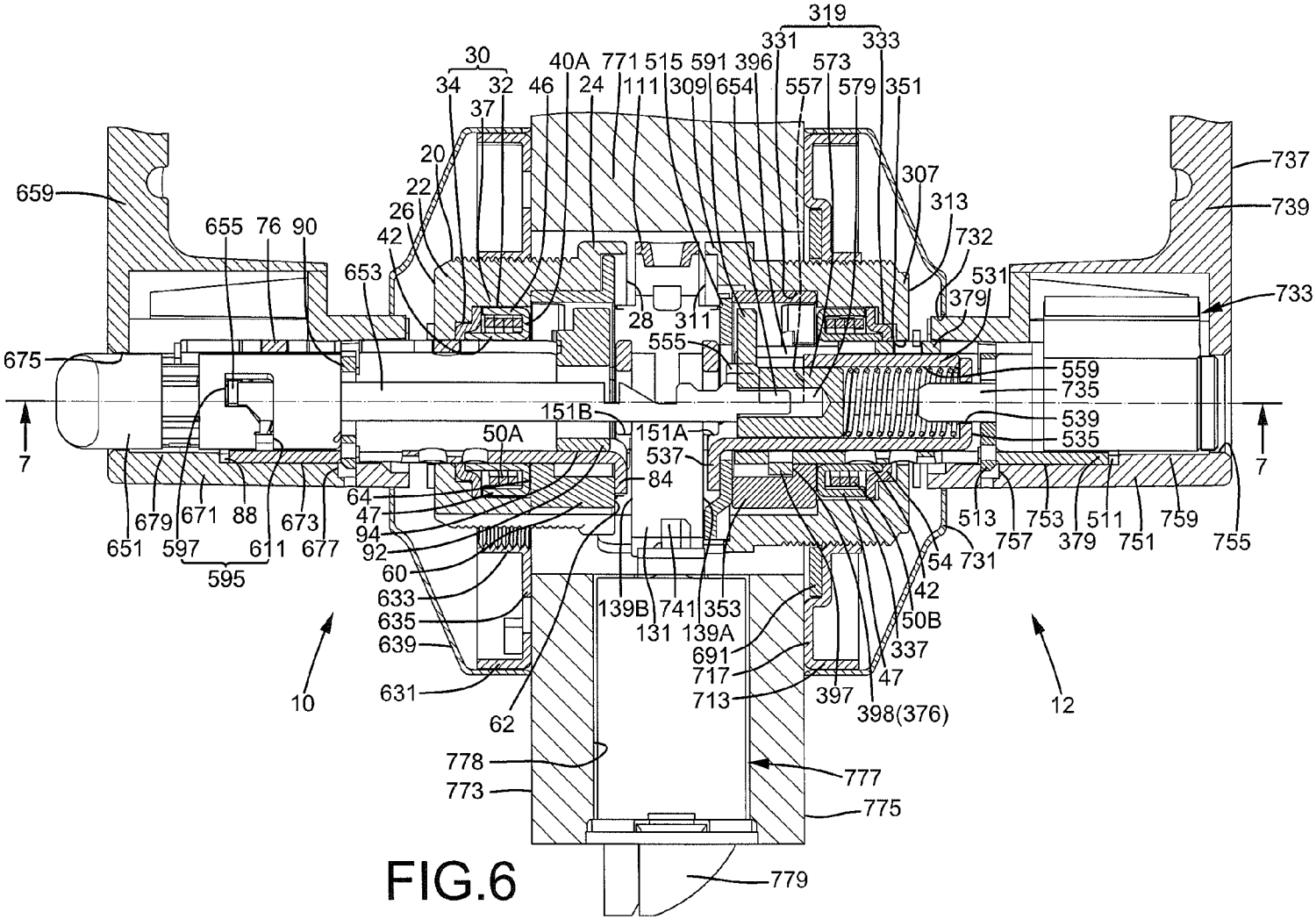
FIG. 6 shows a cross sectional view taken along section line 6-6 of FIG. 5.

A cylindrical lock according to the present invention is shown in the drawings and includes inner and outer operational devices 10 and 12. Inner operational device 10 includes an inner chassis 20 having a seat 22 with an outer threading. Seat 22 includes inner and outer ends 28 and 26 spaced in a longitudinal direction and a flange 24 formed on inner end 28. A space 30 extends from inner end 28 toward but spaced from outer end 26. Specifically, space 30 includes a first chamber 32 extending from inner end 28 toward but spaced from outer end 26 and a second chamber 34 extending from first chamber 32 toward but spaced from outer end 26 and having an inner diameter smaller than that of first chamber 32 (FIG. 6). First chamber 32 includes an inner periphery having two diametrically opposed chamfered faces 36 and two arcuate faces between chamfered faces 36. Four ribs 37 are formed on the inner periphery of first chamber 32 and are respectively located on chamfered faces 36 and the arcuate faces and spaced at regular intervals in a circumferential direction about the longitudinal direction. Inner chassis 20 further includes an axial hole 35 extending from outer end 26 to second chamber 34.

Figure 7:
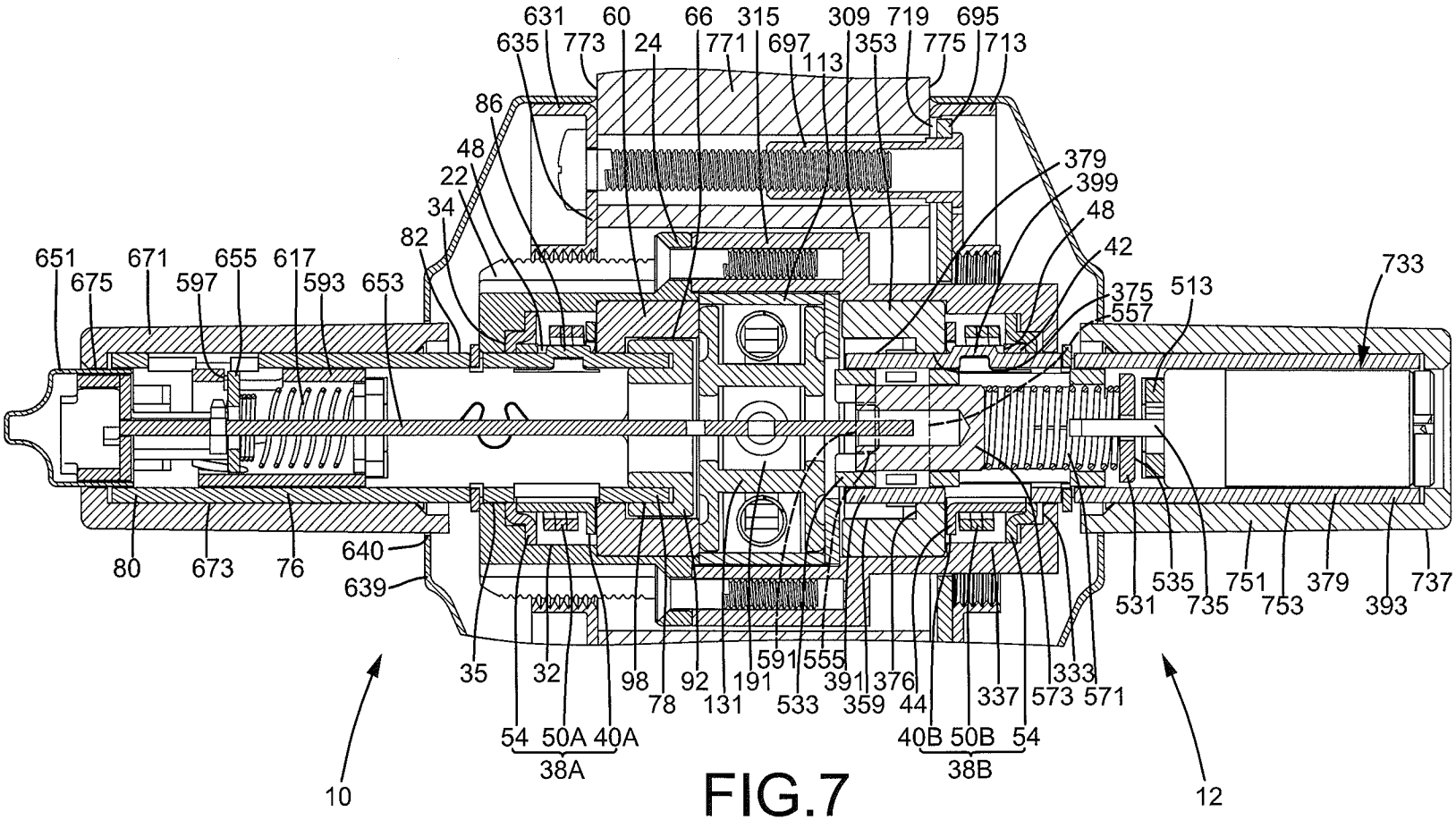
FIG. 7 shows a cross sectional view taken along section line 7-7 of FIG. 6.

With reference to FIGS. 1 and 7, inner operational device 10 further includes an inner returning device 38A (which is identical to outer returning device 38B shown in FIG. 2) including a collar 54 mounted in inner chassis 20. Collar 54 includes a central hole 58 and four insertion grooves 56 on an outer periphery thereof. Collar 54 of inner returning device 38A is received in first chamber 32 and partly extends into second chamber 34 (FIGS. 6 and 7), with collar 54 abutting an end wall of first chamber 32, with central hole 58 aligned with axial hole 35, and with ribs 37 engaged in insertion grooves 56, preventing collar 54 from rotating relative to inner chassis 20.

Figure 2:
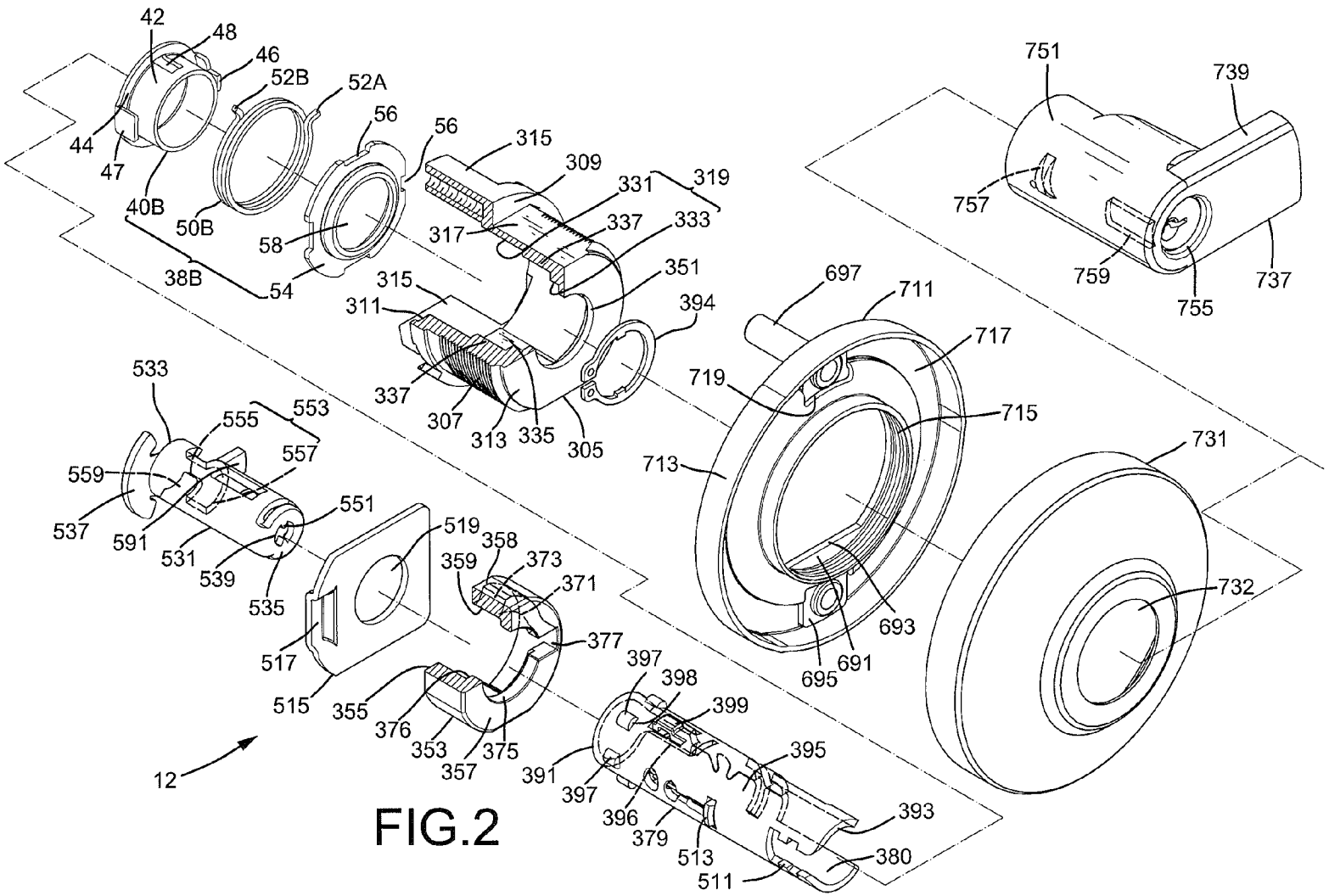
FIG. 2 shows an exploded, perspective view of an outer operational device of the cylindrical lock of FIG. 1.

According to the form shown, inner returning device 38A further includes a push ring 40A (identical to a push ring 40B of outer retaining device 38B in FIG. 2). Push ring 40A includes a sleeve portion 42 having first and second ends spaced along a longitudinal axis thereof. A flange 44 is formed on the first end of sleeve portion 42. An actuating groove 48 is defined in an outer periphery of sleeve portion 42 and adjacent to the first end of sleeve portion 42. A push leg 46 extends from a side of flange 44 toward the second end of sleeve portion 42 and is spaced from the outer periphery of sleeve portion 42 in a radial direction perpendicular to the longitudinal axis of sleeve portion 42. A length of push leg 46 along the longitudinal axis of sleeve portion 42 is smaller than that of sleeve portion 42 (FIG. 6). Push leg 46 is spaced from actuating groove 48 by 90° in the circumferential direction. Push ring 40A further includes a limiting plate 47 extending from flange 44 and diametrically opposite to push leg 46.

According to the form shown, inner returning device 38A further includes a torsion spring 50A mounted around sleeve portion 42 of push ring 40A and having first and second tangs 52A and 52B. A side of torsion spring 50A abuts flange 44. After moving first and second tangs 52A and 52B of torsion spring 50A across each other, first and second tangs 52A and 52B respectively abut two sides of push leg 46 of push ring 40A, with limiting plate 47 abutting an outer periphery of torsion spring 50A. Limiting plate 47 prevents skew of twisted torsion spring 50A. Push ring 40A and torsion spring 50A are received in first chamber 32 of inner chassis 20, with torsion spring 50A located between flange 44 of push ring 40A and collar 54, and with first and second tangs 52A and 52B respectively on two sides of one of ribs 37. Thus, when push ring 40A pivots in the circumferential direction of inner chassis 20, push leg 46 of push ring 40A actuates first tang 52A to move while second tang 52B is retained by rib 37 of inner chassis 20. Namely, torsion spring 50A is twisted to provide a returning force.

Figure 11:
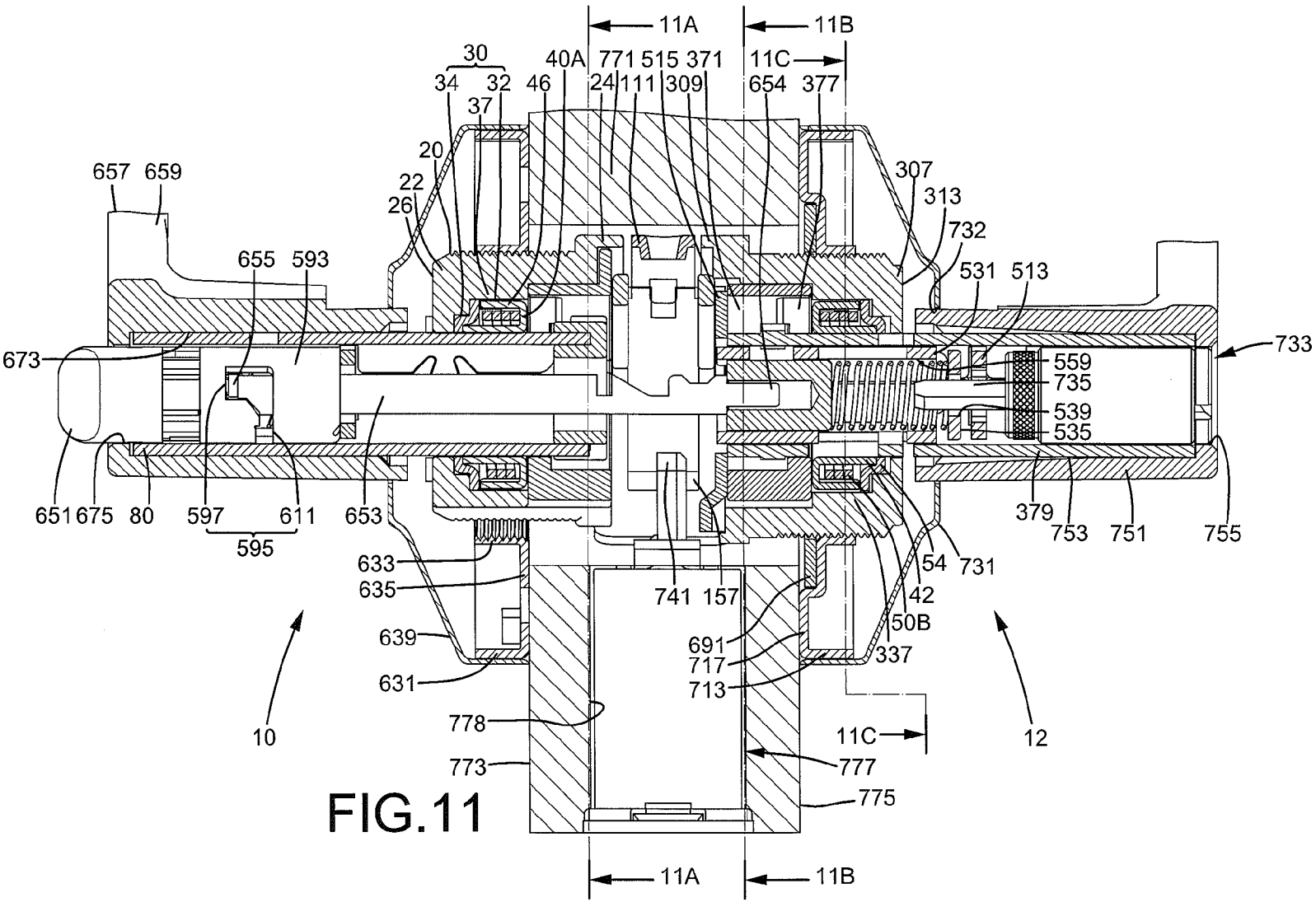
FIG. 11 shows a view similar to FIG. 6, with a latch retracted by operating either an inner handle or an outer handle.
Figure 11A:
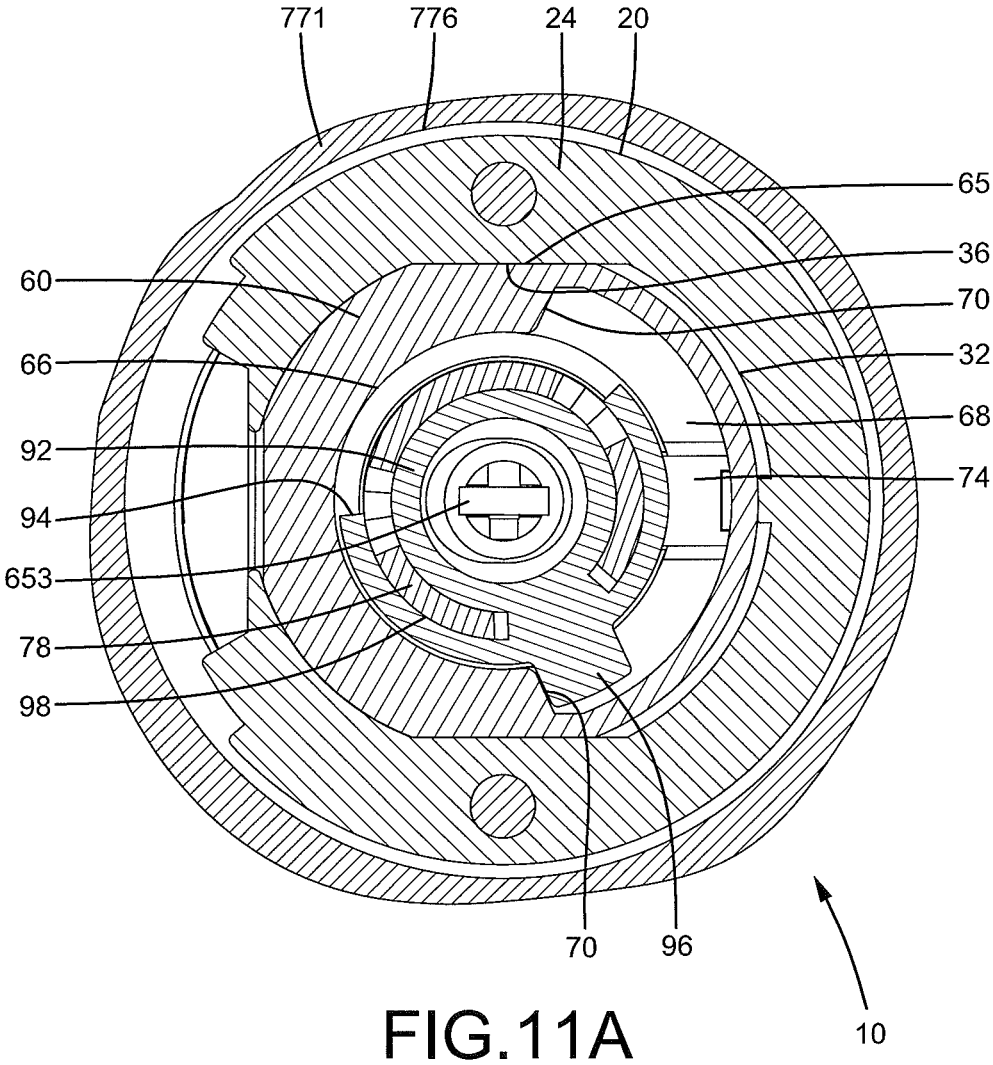
FIG. 11A shows a cross sectional view taken along section line 11A-11A of FIG. 11.

According to the form shown, inner operational device 10 further includes an inner lining 60 mounted in space 30 of inner chassis 20. Inner lining 60 is more rigid than inner chassis 20 and is made of an abrasion-resistant copper-iron alloy having a hardness of HRB80-HRB100. Inner lining 60 includes first and second sides 62 and 64 spaced in the longitudinal direction. Inner lining 60 further includes an outer periphery extending between first and second sides 62 and 64 and having two diametrically opposed chamfered faces 65. Inner lining 60 further includes a receiving compartment 66 extending from first side 62 toward but spaced from second side 64 and having an inner periphery with an arcuate movement groove 68. Movement groove 68 includes two stepped portions 70 spaced in the circumferential direction (FIG. 11A). A pivot hole 72 is defined in second side 64 and extends to receiving compartment 66. Inner lining 60 further includes a restraining groove 74 having rectangular cross sections and extending radially outward from an inner periphery of pivot hole 72. Restraining groove 74 also extends from second side 64 to movement groove 68 in the longitudinal direction and has equal spacing to stepped portions 70 in the circumferential direction. Inner lining 60 further includes an extension 75 extending from first side 62 in a radial direction perpendicular to the longitudinal direction. Inner lining 60 is mounted in first chamber 32 of inner chassis 20, with second side 64 abutting flange 44 of push ring 40A and ribs 37 (FIG. 6), with extension 75 flush with an end face of inner end 28 of inner chassis 20, with restraining groove 74 aligned with push leg 46 of push ring 40A, with receiving compartment 66 aligned with pivot hole 72 and axial hole 35 of inner chassis 20, and with chamfered faces 65 of inner lining 60 abutting chamfered faces 36 of inner chassis 20. Thus, inner lining 60 can not rotate relative to inner chassis 20.

According to the form shown, inner operational device 10 further includes an inner spindle 76 pivotably received in inner chassis 20. Inner spindle 76 is formed by bending a middle carbon steel plate (S50C) having a hardness of HRC35-HRC50. Inner spindle 76 includes inner and outer ends 78 and 80 spaced in the longitudinal direction and an outer periphery 82 extending between inner and outer ends 78 and 80. A sector-shaped lug 84 is formed on inner end 78 and protrudes radially outward away from outer periphery 82. An actuating block 86 protrudes outward from outer periphery 82 (forming a recessed portion in the inner periphery of inner spindle 76) and is located adjacent to inner end 78. An engagement member 90 is received in an intermediate portion of inner spindle 76 and is biased to partially protrude beyond outer periphery 82 in the radial direction. The exposed portion of engagement member 90 can be pressed inward into inner spindle 76. An engagement slot 88 is defined in outer end 80 of inner spindle 76. Inner spindle 76 is pivotably received in axial hole 35 of inner chassis 20. A portion of inner spindle 76 adjacent to inner end 78 is pivotably received in pivot hole 72 of inner lining 60. Lug 84 is located outside of first side 62 of inner lining 60. Outer end 80 of inner spindle 76 is located outside of outer end 26 of inner chassis 20. Actuating block 86 is engaged with actuating groove 48 of push ring 40A (FIG. 7). Thus, push ring 40A can rotate jointly with inner spindle 76 in the circumferential direction. Pivotal movement of push leg 46 of push ring 40A causes movement of first tang 52A of torsion spring 50A to produce the returning force for returning inner spindle 76. Furthermore, since the material of inner spindle 76 is softer than inner lining 60, wear of inner lining 60 is less likely to occur when inner spindle 76 pivots relative to inner lining 60. A retainer ring 615 is mounted around inner spindle 76 and is located adjacent to outer end 26 of inner chassis 20 to prevent inner spindle 76 from disengaging from inner chassis 20 in the longitudinal direction.

According to the form shown, outer operational device 12 includes an outer chassis 305 engaged with inner chassis 20. Outer chassis 305 includes a seat 307 having an outer periphery with an outer threading. Seat 307 includes inner and outer ends 311 and 313 spaced in the longitudinal direction and a flange 309 formed on inner end 311. Two diametrically opposed chamfered faces 317 are formed on the outer periphery of seat 307 of outer chassis 305 and parallel to each other. Two diametrically opposed engagement arms 315 extend from inner end 311 of seat 307 of outer chassis 305. A space 319 extends from inner end 311 toward but spaced from outer end 313. Specifically, space 319 includes a first compartment 331 extending from inner end 311 toward but spaced from outer end 313 and a second compartment 333 extending from first compartment 331 toward but spaced from outer end 313 and having an inner diameter smaller than that of first compartment 331 (FIG. 6). First compartment 331 includes an inner periphery having two diametrically opposed chamfered faces 335 and two arcuate faces between chamfered faces 335. Chamfered faces 335 are parallel to chamfered faces 317. Four ribs 337 are formed on the inner periphery of first compartment 331 and are respectively located on chamfered faces 335 and the arcuate faces and spaced at regular intervals in a circumferential direction about the longitudinal direction. Outer chassis 305 further includes an axial hole 351 extending from outer end 313 to second compartment 333. Engagement arms 315 of outer chassis 305 abut end faces of inner end 28 of inner chassis 20. Two screws are extended through flange 24 into engagement arms 315 to fix inner and outer chassis 20 and 305 together (FIG. 7), with inner end 28 of inner chassis 20 spaced from inner end 311 of outer chassis 305 in the longitudinal direction.

According to the form shown, inner operational device 10 further includes a cylindrical limiting sleeve 593 received in inner spindle 76 and adjacent to outer end 80. Limiting sleeve 593 includes first and second ends 594 and 596 spaced in the longitudinal direction and an L-shaped limiting groove 595 in an outer periphery thereof. Limiting groove 595 includes a first groove section 597 extending in the longitudinal direction and located between first and second ends 594 and 596 and a second groove section 611 extending from an end of first groove section 597 adjacent to first end 594 in the circumferential direction. Limiting sleeve 593 is received in inner spindle 76, with first end 594 of limiting sleeve 593 abutting engaging member 90 of inner spindle 76 (FIG. 6).

According to the form shown, inner operational device 10 further includes a knob 651, an engaging piece 655, and a push rod 653. Push rod 653 includes an end fixed to knob 651 and a distal end 654. Engaging piece 655 is fixed on push rod 653 and adjacent to knob 651. Push rod 653 extends through limiting sleeve 593, inner returning device 38A, inner lining 60, and inner chassis 20, with distal end 654 located outside of inner end 28 of inner chassis 20, and with engaging piece 655 extending into limiting groove 595. Thus, knob 651 can not disengage from inner spindle 76 in the longitudinal direction. A spring 617 is received in limiting sleeve 593 and around push rod 653. Spring 617 is located between second end 596 of limiting sleeve 593 and engaging piece 655, biasing engaging piece 655 to press against an end wall of first groove section 597 of limiting groove 595.

According to the form shown, inner operational device 10 further includes an inner locking ring 619 having an outer periphery 631 and a threaded inner periphery 633 spaced from outer periphery 631 in the radial direction. Two faces 635 extend between inner and outer peripheries 633 and 631 and are spaced in the longitudinal direction. A plurality of through-holes extends from one face 635 through the other face 635 of inner locking ring 619. Inner periphery 633 of inner locking ring 619 is threadedly engaged with seat 22 of inner chassis 20. An inner escutcheon 639 includes a through-hole 640 and is frictionally mounted around outer periphery 631 of inner locking ring 619, with seat 22 of inner chassis 20 located in inner escutcheon 639.

According to the form shown, inner operational device 10 further includes an inner handle 657 having a receiving portion 671 extending in the longitudinal direction and a grip 659 extending from receiving portion 671. Receiving portion 671 includes a coupling hole 673 in an end face thereof. A positioning groove 677 is defined in an inner periphery of coupling hole 673 and is crescent in cross section. A receiving hole 675 is defined in the other end face of receiving portion 671 and extends to coupling hole 673. An engaging block 679 is formed on a bottom wall of positioning groove 677 and adjacent to receiving hole 675. Coupling portion 671 of inner handle 657 extends through through-hole 640 of inner escutcheon 639, with outer end 80 of inner spindle 76 received in coupling hole 673 of inner handle 657. Engaging member 90 of inner spindle 76 is pressed inward by the inner periphery of coupling hole 673 until engaging member 90 is aligned with positioning groove 677. Engaging member 90 is then moved into positioning groove 677, preventing inner handle 657 from disengaging from inner spindle 76 in the longitudinal direction. Furthermore, engaging block 679 is engaged in engagement slot 88 of inner spindle 76 (FIG. 6). Thus, when inner handle 657 is pivoted such as by operating grip 659, engaging block 679 is pushed by a wall of engagement slot 88, causing pivotal movement of inner spindle 76. Further, knob 651 is partially received in receiving hole 675 and has a portion exposed outside of receiving hole 675.

According to the form shown, outer operational device 12 includes an outer chassis 305 engaged with inner chassis 20. Outer chassis 305 includes a seat 307 having an outer periphery with an outer threading. Seat 307 includes inner and outer ends 311 and 313 spaced in the longitudinal direction and a flange 309 formed on inner end 311. Two diametrically opposed chamfered faces 317 are formed on the outer periphery of seat 307 of outer chassis 305 and parallel to each other. Two diametrically opposed engagement arms 315 extend from inner end 311 of seat 307 of outer chassis 305. A space 319 extends from inner end 311 toward but spaced from outer end 313. Specifically, space 319 includes a first compartment 331 extending from inner end 311 toward but spaced from outer end 313 and a second compartment 333 extending from first compartment 331 toward but spaced from outer end 313 and having an inner diameter smaller than that of first compartment 331 (FIG. 6). First compartment 331 includes an inner periphery having two diametrically opposed chamfered faces 335 and two arcuate faces between chamfered faces 335. Chamfered faces 335 are parallel to chamfered faces 317. Four ribs 337 are formed on the inner periphery of first compartment 331 and respectively located on chamfered faces 335 and the arcuate faces and spaced at regular intervals in a circumferential direction about the longitudinal direction. Outer chassis 305 further includes an axial hole 351 extending from outer end 313 to second compartment 333. Engagement arms 315 of outer chassis 305 abut end faces of inner end 28 of inner chassis 20. Two screws are extended through flange 24 into engagement arms 315 to fix inner and outer chassis 20 and 305 together (FIG. 7), with inner end 28 of inner chassis 20 spaced from inner end 311 of outer chassis 305 in the longitudinal direction.

According to the form shown, outer operational device 12 further includes an outer returning device 38B which is identical to inner returning device 38A. Specifically, outer returning device 38B includes a push ring 40B identical to push ring 40A and a torsion spring 50B identical to torsion spring 50A. A collar 54 is mounted in outer chassis 305 and includes a central hole 58 and four insertion grooves 56 on an outer periphery thereof. Collar 54 of outer returning device 38B is received in first compartment 331 and partly extending into second compartment 333 (FIGS. 6 and 7), with collar 54 abutting an end wall of first compartment 331, with central hole 58 aligned with axial hole 351, and with ribs 337 engaged in insertion grooves 56 of collar 54 of outer returning device 38B, preventing collar 54 from rotating relative to outer chassis 305.

Figure 11B:
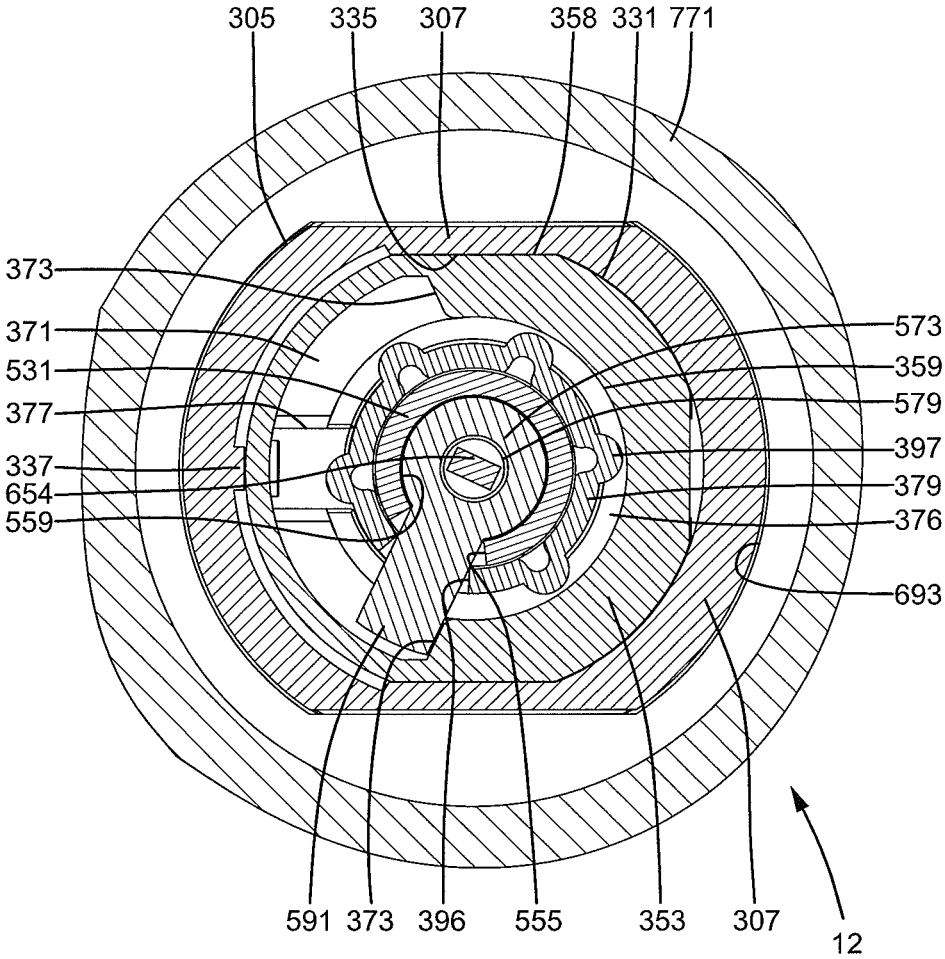
FIG. 11B shows a cross sectional view taken along section line 11B-11B of FIG. 11.
Figure 11C:
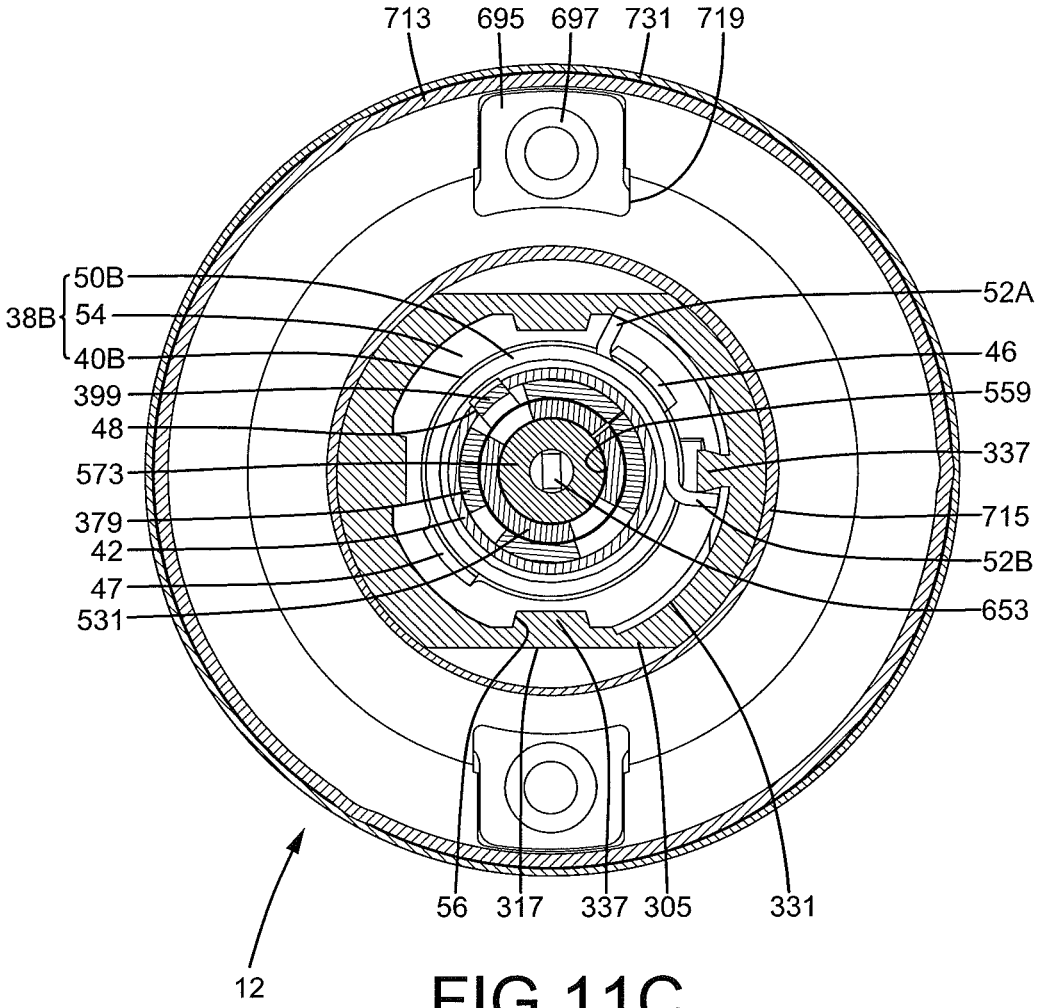
FIG. 11C shows a cross sectional view taken along section line 11C-11C of FIG. 11.

According to the form shown, torsion spring 50B of outer returning device 38B is mounted around sleeve portion 42 of push ring 40B and has a side abutting flange 44 of push ring 40B. After moving first and second tangs 52A and 52B of torsion spring 50B across each other, first and second tangs 52A and 52B of torsion spring 50B respectively abut two sides of push leg 46 of push ring 40B, with limiting plate 47 of push ring 40B abutting an outer periphery of torsion spring 50A. Limiting plate 47 of push ring 40B prevents skew of twisted torsion spring 50B. Push ring 40B and torsion spring 50B are received in first compartment 331 of outer chassis 305, with torsion spring 50B located between flange 44 of push ring 40B and collar 54 of outer returning device 38B, and with first and second tangs 52A and 52B of torsion spring 50B respectively on two sides of one of ribs 337. Thus, when push ring 40B pivots in the circumferential direction, push leg 46 of push ring 40B actuates first tang 52A of torsion spring 50B to move while second tang 52B of torsion spring 50B is retained by rib 337 of outer chassis 305. Thus, torsion spring 50B is twisted to provide a returning force (FIG. 11C).

Figure 8:
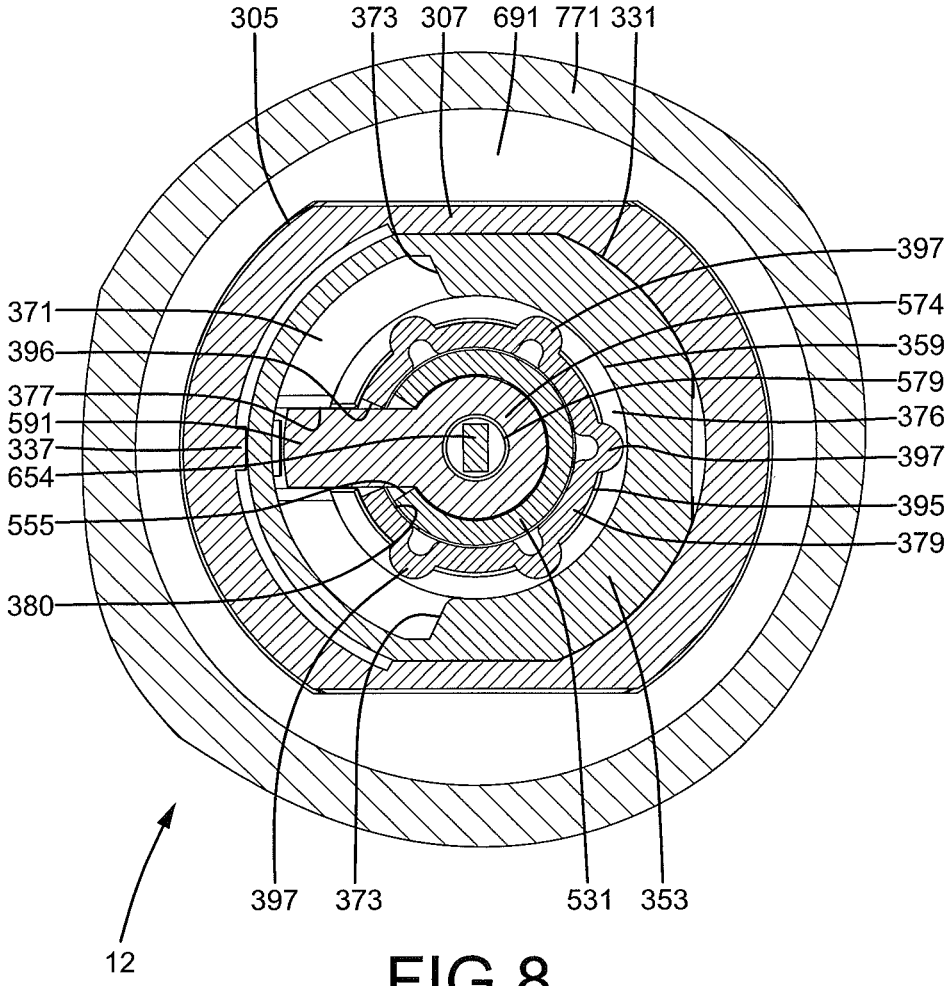
FIG. 8 shows a cross sectional view taken along section line 8-8 of FIG. 5.
Figure 9:
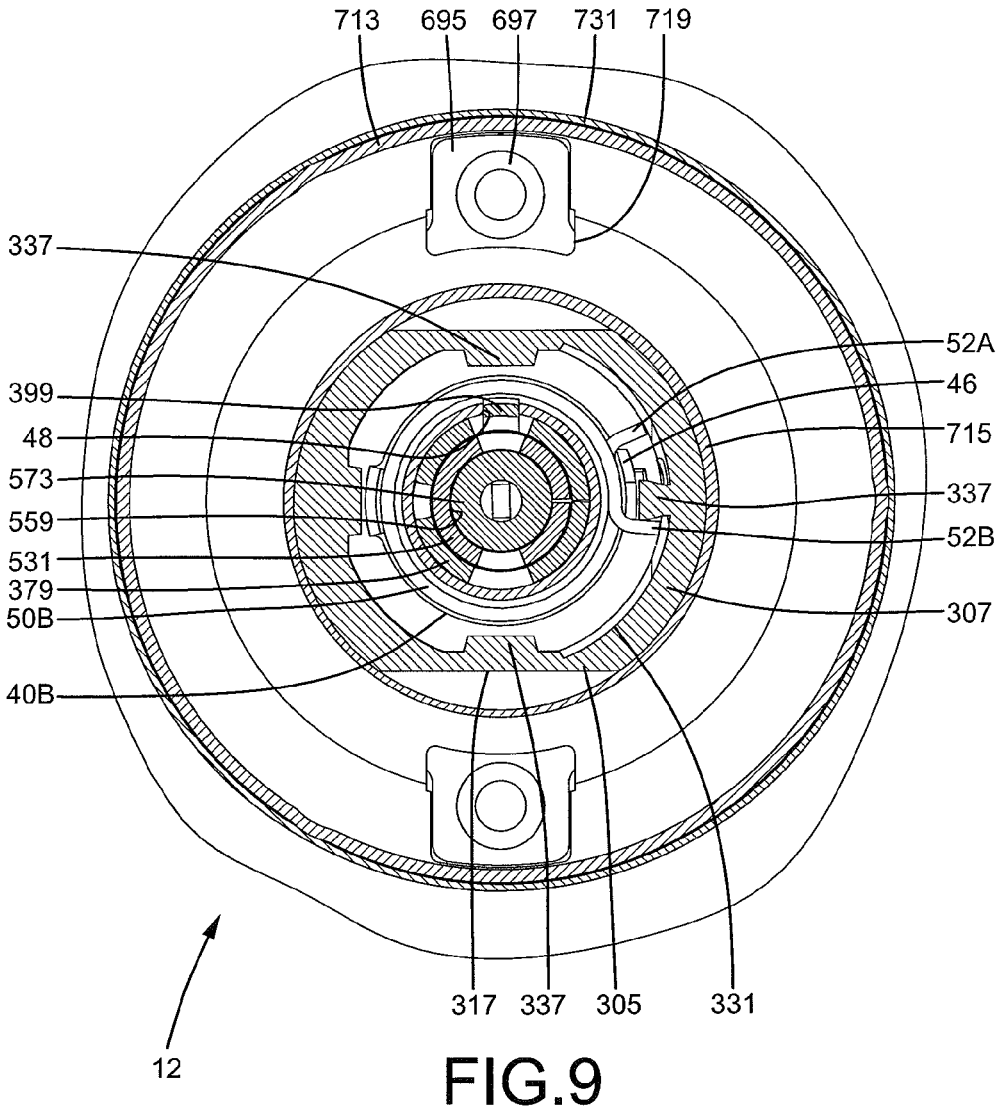
FIG. 9 shows a cross sectional view taken along section line 9-9 of FIG. 5.

According to the form shown, outer operational device 12 further includes an outer lining 353 engaged in space 319 of outer chassis 305. Outer lining 353 is more rigid than outer chassis 305 and is made of an abrasion-resistant copper-iron alloy having a hardness of HRB80-HRB100. Outer lining 353 includes first and second sides 355 and 357 spaced in the longitudinal direction. Outer lining 353 further includes an outer periphery extending between first and second sides 355 and 357 and having two diametrically opposed chamfered faces 358. Outer lining 353 further includes a receiving compartment 359 extending from first side 355 toward but spaced from second side 357 and having an inner periphery with an arcuate movement groove 371. Movement groove 371 includes two stepped portions 373 spaced in the circumferential direction (FIG. 8). A pivot hole 375 is defined in second side 357 and extends to receiving compartment 359, with an abutment face 376 formed in an intersection between receiving compartment 359 and pivot hole 375. Outer lining 353 further includes a restraining groove 377 having rectangular cross sections and extending radially outward from an inner periphery of pivot hole 375. Restraining groove 377 also extends from second side 357 to movement groove 371 in the longitudinal direction and has equal spacing to stepped portions 373 in the circumferential direction. Outer lining 353 is mounted in first compartment 331 of outer chassis 305, with second side 357 abutting flange 44 of push ring 40B and ribs 337 (FIG. 6), with restraining groove 377 aligned with push leg 46 of push ring 40B, with receiving compartment 359 aligned with pivot hole 375 and axial hole 351 of outer chassis 305, and with chamfered faces 358 of outer lining 353 abutting chamfered faces 335 of outer chassis 3050. Thus, outer lining 353 can not rotate relative of outer chassis 305.

According to the form shown, outer operational device 12 further includes an outer spindle 379 pivotably received in outer chassis 305. Outer spindle 379 is formed by bending a middle carbon steel plate (S50C) having a hardness of HRC35-HRC50. Outer spindle 379 includes inner and outer ends 391 and 393 spaced in the longitudinal direction and an outer periphery 395 extending between inner and outer ends 391 and 393. A receiving space 380 extends from inner end 391 through outer end 393. An actuating block 399 protrudes outward from outer periphery 395 (forming a recessed portion in the inner periphery of outer spindle 379) and is located adjacent to inner end 391 (FIG. 7). An insertion slot 396 extends from inner end 391 toward but spaced from outer end 393 and is spaced from actuating block 399 by 90° in the circumferential direction. A plurality of restraining protrusions 397 protrudes outward from outer periphery 395 (forming a plurality of recessed portions in the inner periphery of outer spindle 379, see FIG. 8) and is located between an end face of inner end 391 and actuating block 399. Restraining protrusions 397 are spaced at regular intervals in the circumferential direction and have equal spacing to the end face of inner end 391. Each restraining protrusion 397 includes an abutment surface 398 facing outer end 393. An engagement slot 511 is defined in outer end 393. An engagement member 513 is received in an intermediate portion of outer spindle 379 and is biased to partially protrude beyond outer periphery 395 in the radial direction. The exposed portion of engagement member 513 can be pressed inward into outer spindle 379.

Outer spindle 379 is pivotably received in axial hole 351 of outer chassis 305. A portion of outer spindle 379 adjacent to inner end 391 is pivotably received in pivot hole 375 of outer lining 353. Each restraining protrusion 397 is received in receiving compartment 359, with abutment surface 398 abutting abutment face 376 to prevent outer spindle 379 from disengaging from outer chassis 305 in the longitudinal direction by avoiding movement of outer spindle 379 away from inner end 311 of outer chassis 305 in the longitudinal direction. Outer end 393 of outer spindle 379 is located outside of outer end 313 of outer chassis 305. Actuating block 399 is engaged with actuating groove 48 of push ring 40B (FIG. 7). Thus, push ring 40B can rotate jointly with outer spindle 379 in the circumferential direction. Pivotal movement of push leg 46 of push ring 40B causes movement of first tang 52A of torsion spring 50B to produce the returning force for returning outer spindle 379. Furthermore, since the material of outer spindle 379 is softer than outer lining 353, wear of outer lining 353 is less likely to occur when outer spindle 379 pivots relative to outer lining 353 A retainer ring 394 is mounted around outer spindle 379 and located adjacent to outer end 313 of outer chassis 305 to prevent outer spindle 379 from disengaging from outer chassis 305 in the longitudinal direction.

According to the form shown, outer operational device 12 further includes a lid 515 mounted to outer chassis 305. Lid 515 includes a side having a protrusion 517 and a through-hole 519 extending from the side of lid 515 through the other side of lid 515. Lid 515 is mounted to the end face of inner end 311 of outer chassis 305, with through-hole 519 aligned with axial hole 351 of outer chassis 305. Protrusion 517 is spaced from each engagement arm 315 by 90°. Push rod 653 of inner operational device 10 extends through through-hole 519 of lid 515 into space 319 of outer chassis 305.

According to the form shown, outer operational device 12 further includes an actuating cylinder 531 pivotably received in outer spindle 379. Actuating cylinder 531 includes a first end 533 and a second end 535, with a receptacle 559 extending from first end 533 toward but spaced from second end 535. Second end 535 includes an actuating hole 539 in communication with receptacle 559. Two teeth 551 are diametrically formed on an inner periphery of actuating hole 539. A sector-shaped tab 537 extends radially outward from first end 533. Actuating cylinder 531 further includes a T-shaped channel 553 formed in first end 533 and in communication with receptacle 559. Channel 553 includes a narrower portion 555 extending from an end face of first end 533 toward but spaced from second end 535 and a wider portion 557 extending in the circumferential direction and intersecting an end of narrower portion 555 distant to first end 533. Actuating cylinder 531 is pivotably received in receiving space 380 of outer spindle 379, with outer spindle 379 located between actuating cylinder 531 and outer chassis 305 in the radial direction. First end 533 and tab 537 of actuating cylinder 531 extend through through-hole 519 of lid 515 and are, thus, located beyond inner end 311 of outer chassis 305. Channel 553 of actuating cylinder 531 is aligned with insertion slot 396 of outer spindle 379.

According to the form shown, outer operational device 12 further includes a locking member 573 pivotably received in actuating cylinder 531. Locking member 573 includes a cylindrical portion 574 having first and second end faces 575 and 577 spaced in the longitudinal direction. A blind hole 579 is defined in first end face 575. A tail 591 is formed on an outer periphery of cylindrical portion 574 and adjacent to first end face 575. Locking member 573 is pivotably received in receptacle 559 of actuating cylinder 531, with first end face 575 facing lid 515. Tail 591 extends radially through channel 553 of actuating cylinder 531 and insertion slot 396 of outer spindle 379 into movement groove 371 of outer lining 353 (FIGS. 6 and 8). When tail 591 is in narrower portion 555 of channel 553, two lateral faces of narrower portion 555 abut two sides of tail 591. When tail 591 is in wider portion 557 of channel 553, two lateral faces of wider portion 557 are spaced from the two sides of tail 591. A spring 571 is mounted between closed, second end 535 of actuating cylinder 531 and locking member 573 to bias first end face 575 of locking member 573 to abut a side of lid 515. Distal end 654 of push rod 653 is engaged in blind hole 579 of locking member 573. Thus, locking member 573 can move jointly with push rod 653 in the longitudinal direction when push rod 653 is moved in the longitudinal direction.

According to the form shown, outer operational device 12 further includes a key-operable lock core 733 partially received in outer spindle 379. Lock core 733 includes a tail piece 735 extending beyond a side thereof. Tail piece 735 pivots in the circumferential direction when lock core 733 is operated by a key. A portion of lock core 733 is received in receiving space 380 of outer spindle 379 and adjacent to outer end 393 (FIG. 6). The side of lock core 733 abuts a face of engagement member 513. Tail piece 735 extends through engagement member 513 into actuating hole 539 of actuating cylinder 531. When tail piece 735 pivots, one of teeth 551 is pushed to cause pivotal movement of actuating cylinder 531.

According to the form shown, outer operational device 12 further includes a connecting plate 691 having a non-circular connecting hole 693 with cross sections corresponding to those of seat 307 of outer chassis 305. Two ears 695 extend radially outward from an outer periphery of connecting plate 691. A mounting post 697 extends through each ear 695. Connecting plate 691 is mounted around seat 307 of outer chassis 305. Due to provision of non-circular connecting hole 693, connecting plate 691 can not rotate relative to outer chassis 305.

According to the form shown, outer operational device 12 further includes an outer locking ring 711 having an outer periphery 713 and a threaded inner periphery 715 spaced from outer periphery 713 in the radial direction. Two faces 717 extend between inner and outer peripheries 715 and 713 and are spaced in the longitudinal direction. Two diametrically opposed slots 719 extend from one face 717 through the other face 717 of outer locking ring 711 and are located between inner and outer peripheries 715 and 713. Inner periphery 715 of outer locking ring 711 is threadedly engaged with seat 307 of outer chassis 305, with ears 695 of connecting plate 691 engaged in slots 719 of outer locking ring 711. An outer escutcheon 731 includes a through-hole 732 and is frictionally mounted around outer periphery 713 of outer locking ring 711, with seat 307 of outer chassis 305 located in outer escutcheon 731.

According to the form shown, outer operational device 12 further includes an outer handle 737 having a receiving portion 751 extending in the longitudinal direction and a grip 739 extending from receiving portion 751. Receiving portion 751 includes a coupling hole 753 in an end face thereof. A positioning groove 757 is defined in an inner periphery of coupling hole 753 and is crescent in cross section. A receiving hole 755 is defined in the other end face of receiving portion 751 and extends to coupling hole 753. An engaging block 759 is formed on a bottom wall of coupling hole 753 and adjacent to receiving hole 755. Receiving portion 751 of outer handle 737 extends through through-hole 732 of outer escutcheon 731, with outer end 393 of outer spindle 379 received in coupling hole 753 of outer handle 737. Engagement member 513 of outer spindle 379 is pressed inward by the inner periphery of coupling hole 753 until engagement member 513 is aligned with positioning groove 757. Engagement member 513 is then moved into positioning groove 757, preventing outer handle 737 from disengaging from outer spindle 379 in the longitudinal direction. Furthermore, engaging block 759 is engaged in engagement slot 511 of outer spindle 379 (FIG. 6). Thus, when outer handle 737 is pivoted such as by operating grip 739, engaging block 759 is pushed by a wall of engagement slot 511, causing pivotal movement of outer spindle 379.

Figure 10:
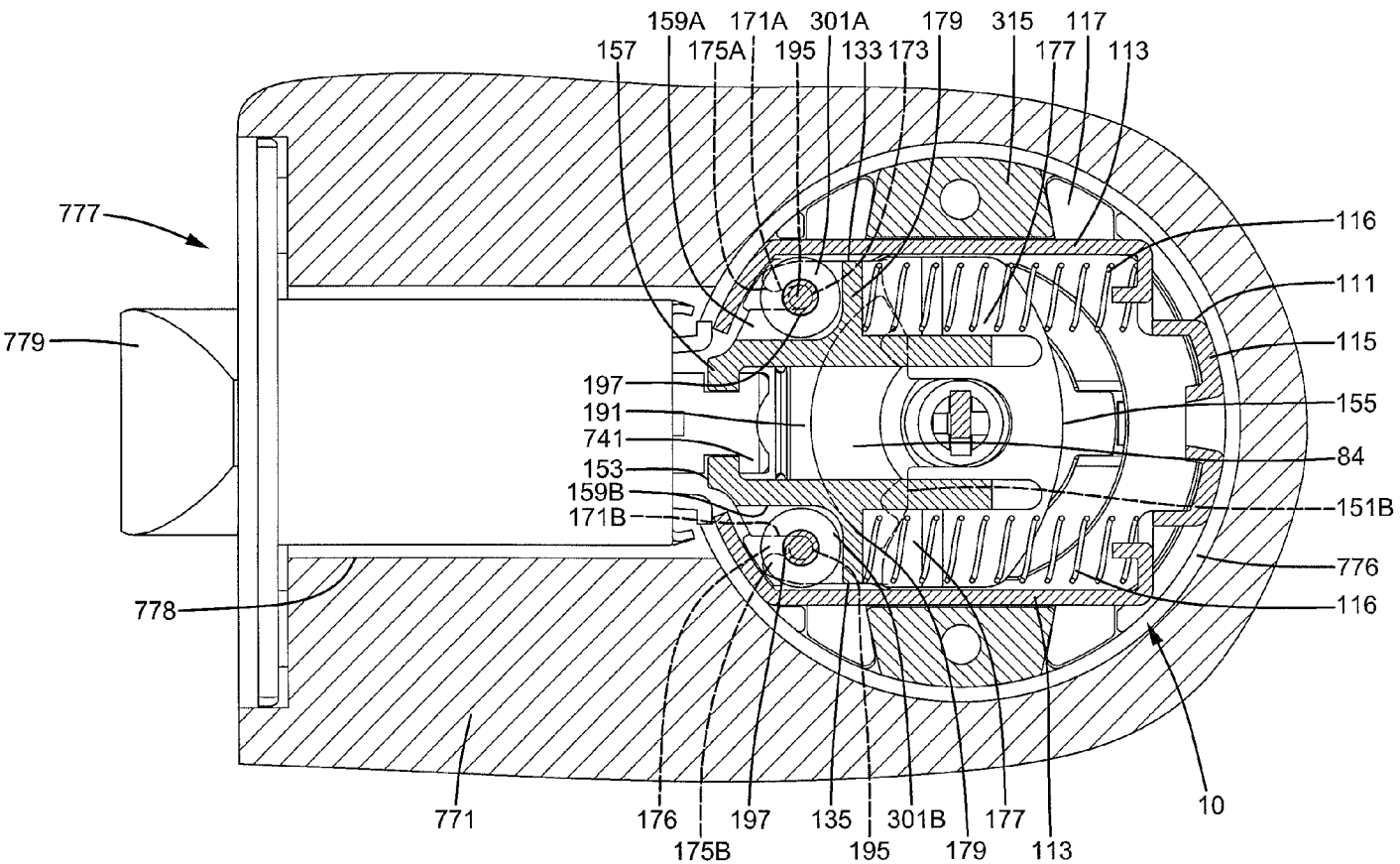
FIG. 10 shows a cross sectional view taken along section line 10-10 of FIG. 5.

According to the form shown, the cylindrical lock further includes a jacket 111 between inner and outer chassis 20 and 305. Jacket 111 includes upper and lower walls 113 spaced in the vertical direction and an intermediate wall 115 extending between upper and lower walls 113. Each of upper and lower walls 113 includes an end distant to intermediate wall 115 and having a notch 119. Each of upper and lower walls 113 further includes four ears 117 on two lateral edges thereof. Jacket 111 is mounted between inner end 28 of inner chassis 20 and inner end 311 of outer chassis 305, with ears 117 abutting two sides of each engagement arm 315 (FIG. 10).

Figure 3:
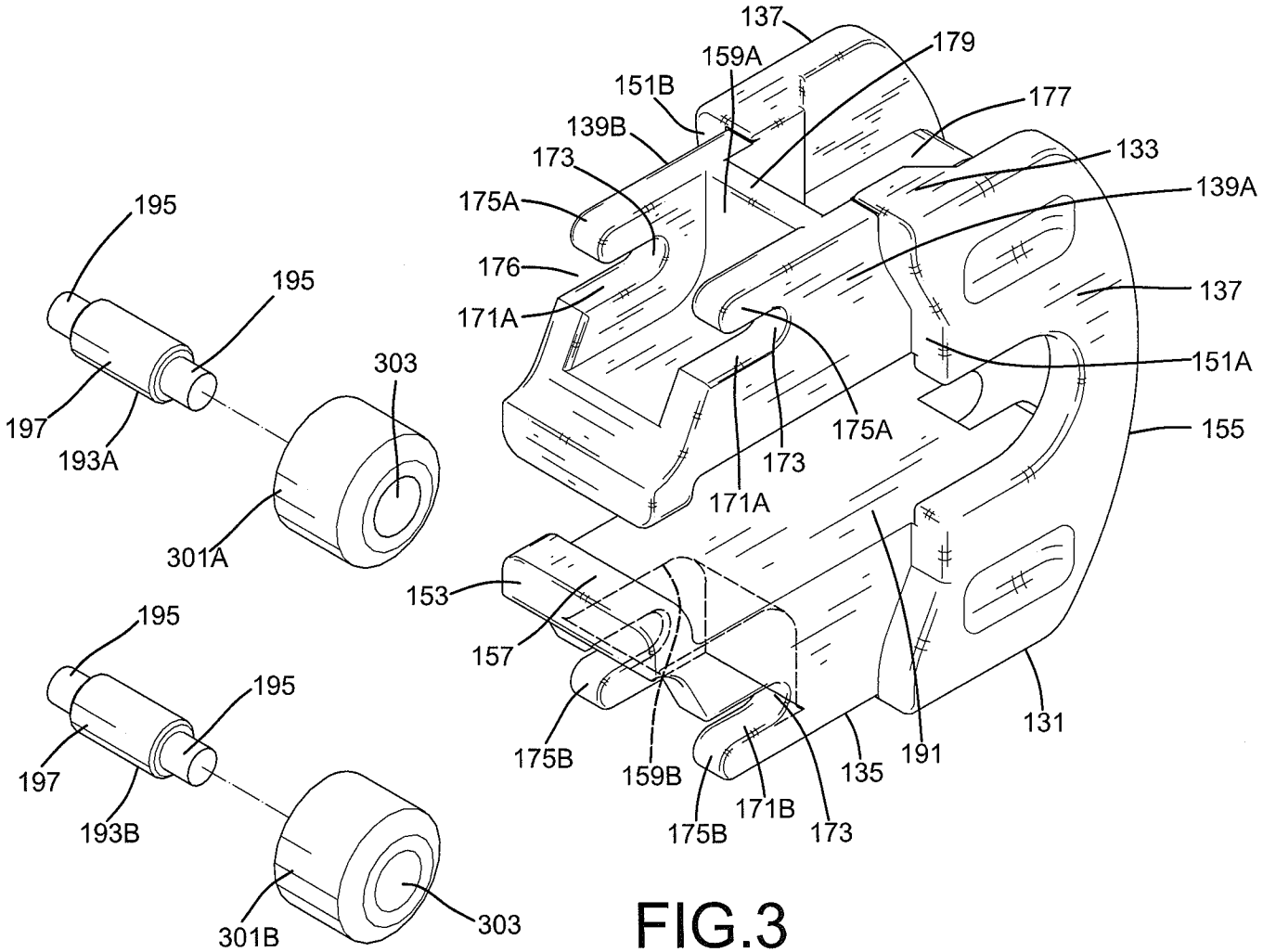
FIG. 3 shows an exploded, perspective view of a retractor of the cylindrical lock of FIG. 1.

According to the form shown, the cylindrical lock further includes a retractor 131 having front and rear ends 153 and 155 and two spaced lateral surfaces 137 extending between front and rear ends 153 and 155. Retractor 131 further includes upper and lower surfaces 133 and 135 extending between front and rear ends 153 and 155 and extending between lateral surfaces 137, with upper and lower surfaces 133 and 135 spaced from each other in a vertical direction perpendicular to the longitudinal direction. First and second recessed portions 139A and 139B are respectively defined in lateral surfaces 137, spaced in the longitudinal direction and located adjacent to front end 153. A first push face 151A is formed between an intersection between first recessed portion 139A and one of lateral surfaces 137. A second push face 151B is formed between an intersection between second recessed portion 139B and the other lateral surface 137. An upper recess .159A is defined in upper surface 133 and is located between first and second recessed portions 139A and 139B. ,A lower recess 159B is defined in lower surface 135 and is located between first and second recessed portions 139A and 139B and spaced from upper recess 159A in the vertical direction. Each of upper and lower recesses 159A and 159B includes two sidewalls spaced in the longitudinal direction. Two upper compartments 171A are defined in the sidewalls of upper recess 159A and are located adjacent to upper surface 133 and extend to first and second recessed portions 139A and 139B, respectively, forming two upper tongues 175A spaced in the longitudinal direction. Two lower compartments 171B are defined in the sidewalls of lower recess 159B and are located adjacent to lower surface 135 and extend to first and second recessed portions 139A and 139B, respectively, forming two lower tongues 175B spaced in the longitudinal direction. Each of upper and lower compartments 171A and 171E includes an opening 176 and an end wall 173 connected to one of upper and lower tongues 175A and 175B (FIG. 3). Two hooks 157 are formed on front end 153 of retractor 131 and are spaced in the vertical direction. A groove 177 is defined in each of upper and lower surfaces 133 and 135 and extends to rear end 155, with a partitioning wall 179 formed between each groove 177 and one of upper and lower recesses 159A and 159B. A passage 191 extends from one of lateral surfaces 137 through the other lateral surface 137 in the longitudinal direction.

Retractor 131 is slideably received between upper and lower walls 113 and intermediate wall 115 of jacket 111, with front end 153 of retractor 131 located adjacent to notches 119, with lateral surfaces 137 of retractor 131 respectively abutting lid 515 and extension 75 of inner lining 60, with protrusion 517 of lid 515 abutting a face of second recessed portion 139B, and with rear end 155 of retractor 131 facing the intermediate wall 115 of jacket 111. A plurality of springs 116 is mounted in grooves 177 of retractor 131, with each spring 116 located between intermediate wall 115 and of jacket 111 and one of partitioning walls 179 of retractor 131 (FIG. 10), biasing front end 153 of retractor 131 to a position adjacent to notches 119 of jacket 111. Lateral surfaces 137 of retractor 131 are located between extension 75 of inner lining 60 and lid 515. Lug 84 of inner spindle 76 is received in first recessed portion 139A of retractor 131, with two ends of lug 84 abutting first push face 151A. Tab 537 of actuating cylinder 531 is received in second recessed portion 139B, with two ends of tab 537 abutting second push face 151B.

According to the form shown, the cylindrical lock further includes first and second pivots 193A and 193B each including two engagement sections 195 spaced in the longitudinal direction and each having a diameter slightly smaller than upper and lower compartments 171A and 171B. Each of first and second pivots 193A and 193B further includes a pivotal section 197 between engagement sections 195 and having a diameter larger than that of engagement sections 195. A length of pivotal section 197 of first pivot 193A in the longitudinal direction is slightly smaller than a spacing between upper compartments 171A in the longitudinal direction. A length of pivotal section 197 of second pivot 193B in the longitudinal direction is slightly smaller than a spacing between lower compartments 171B in the longitudinal direction.

According to the form shown, the cylindrical lock further includes first and second rollers 301A and 301B. Each of first and second rollers 301A and 301B is cylindrical and includes a pivot hole 303 having an inner diameter slightly larger than the diameter of first and second pivots 193A and 193B. Pivotal section 197 of first pivot 193A is rotatably received in pivot hole 303 of first roller 301A, with engagement sections 195 of first pivot 193A located outside of first roller 301A. Pivotal section 197 of second pivot 193B is rotatably received in pivot hole 303 of second roller 301B, with engagement sections 195 of second pivot 193B located outside of second roller 301B. Engagement sections 195 of first pivot 193A are engaged in upper compartments 171A and abut end walls 173 of upper compartments 171A, with first roller 301A received in upper recess 159A, and with a portion of first roller 301A extending beyond upper surface 133. Engagement sections 195 of second pivot 193B are engaged in lower compartments 171B and abut end walls 173 of lower compartments 171B, with second roller 301B received in lower recess 159B, and with a portion of second roller 301B extending beyond lower surface 135.

Figure 4:
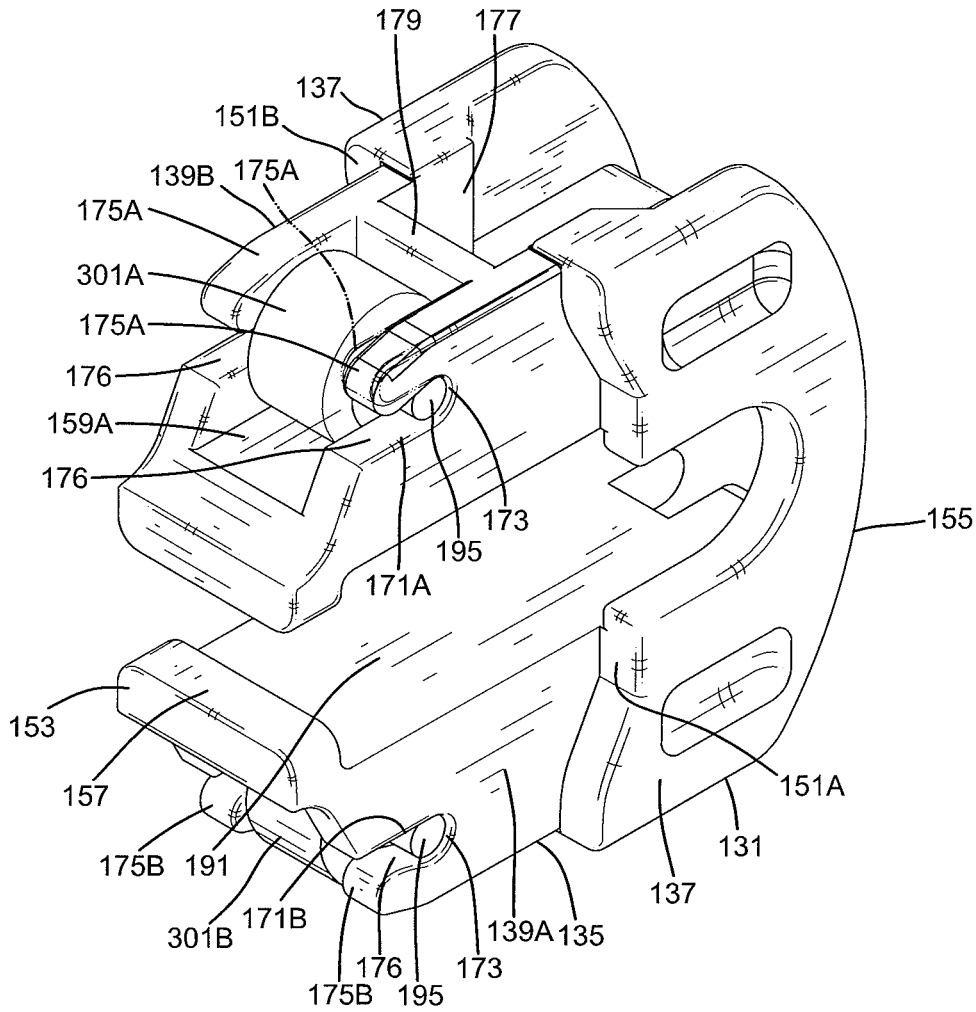
FIG. 4 shows a perspective view of the retractor of FIG. 3.

With reference to FIGS. 3 and 4, after first and second pivots 193A and 193B are engaged in upper and lower compartments 171A and 171B, a distal end of each upper tongue 175A is pressed downward, and a distal end of each lower tongue 175B is pressed upward, reducing the sizes of openings 176 of upper and lower compartments 171A and 171B to retain first and second pivots 193A and 193B in upper and lower compartments 171A and 171B without the risk of disengagement. First and second rollers 301A and 301B are rollable on upper and lower walls 113 of jacket 111. When retractor 131 moves away from or toward notches 119 of jacket 111 in a transverse direction perpendicular to the vertical and longitudinal directions, first and second rollers 301A and 301B roll on upper and lower walls 113 of jacket 111, allowing smooth movement of retractor 131.

Figure 5:
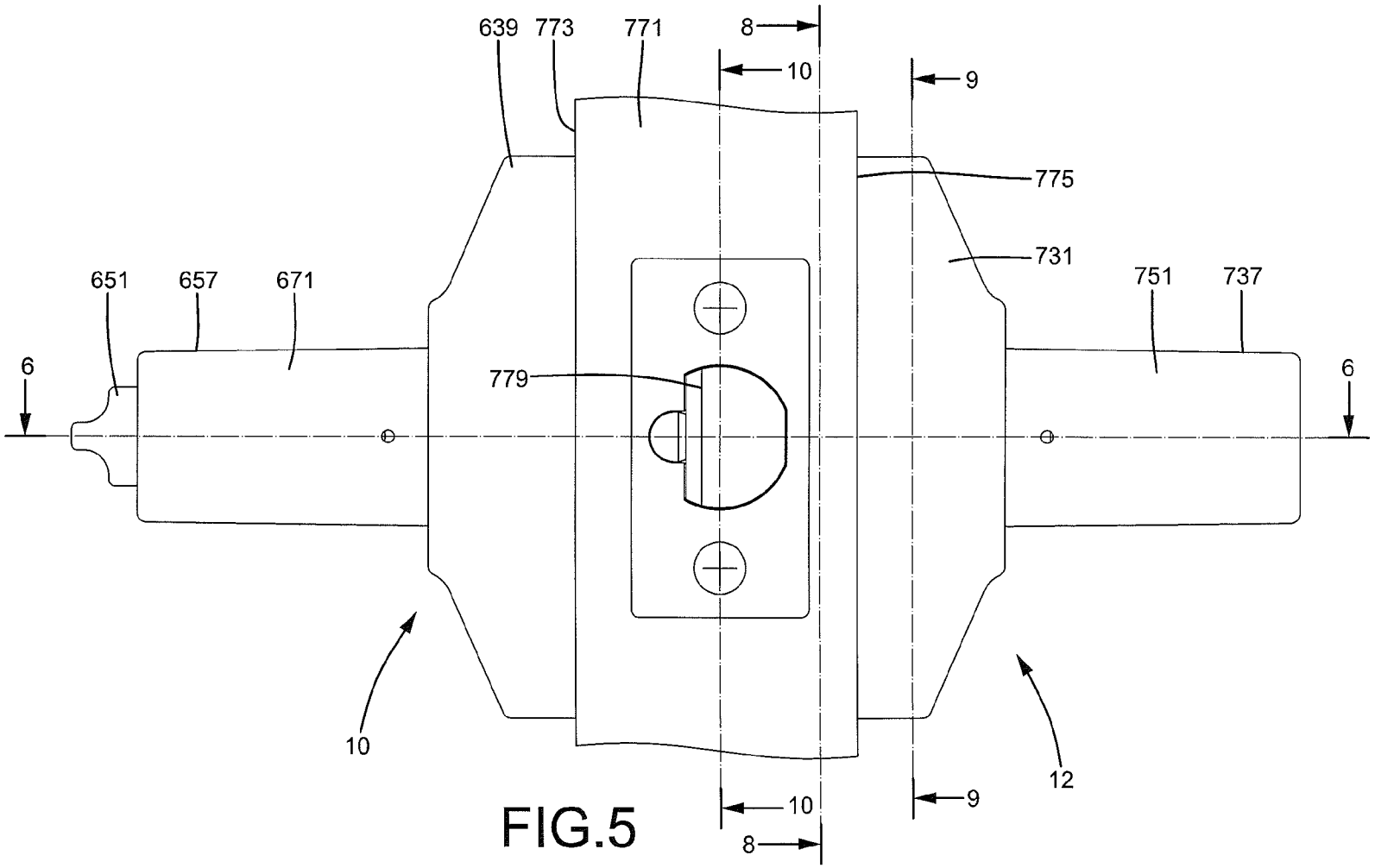
FIG. 5 shows a side view of the cylindrical lock mounted to a door.

With reference to FIGS. 5-7, the cylindrical lock is mounted to a door 771 having inner and outer sides 773 and 775 and an end face between inner and outer sides 773 and 775. A first mounting hole 776 extends from inner side 773 through outer side 775 of door 771. A second mounting hole 778 extends from the end face of door 771 to first mounting hole 776 (FIG. 6). A latch device 777 is mounted in second mounting hole 778 and can be of any desired form as conventional, including, but not limited to, of a commercially available type. In the form shown, latch device 777 includes a latch 779 and a drawing member 741 connected to latch 779. Latch 779 is normally in a latching position outside of door 771 (FIG. 6) and can be moved to an unlatching position (FIG. 11) in second mounting hole 778. Drawing member 741 extends into first mounting hole 776.

After engagement, inner and outer chassis 20 and 305 are mounted in first mounting hole 776, with hooks 157 of retractor 131 engaged with drawing member 741 of latch device 777. Inner locking ring 619 of inner operational device 10 abuts inner side 773 of door 771. Outer locking ring 711 of outer operational device 12 abuts outer side 775 of door 771. Mounting posts 697 of connecting plate 691 extend into door 771. Two screws 637 are extended through inner locking ring 619 into screw holes in mounting posts 697, fixing inner and outer locking rings 619 and 711 to door 771. Thus, inner and outer chassis 20 and 305 are fixed in door 771. Furthermore, since mounting posts 697 extend through door 771 and since connecting plate 691 can not rotate relative to outer chassis 305, connecting plate 691 avoids rotational movement of inner and outer chassis 20 and 305 relative to door 771 while operating inner and outer handles 657 and 737.

Now that the basic construction of the cylindrical lock of the present invention has been explained, the operation and some of the advantages of the cylindrical lock can be set forth and appreciated. In particular, for the sake of explanation, it will be assumed that latch 779 of latch device 777 is in the latching position (FIG. 6), with front end 153 of retractor 131 located in a first position adjacent to notches 119 of jacket 111, with engaging piece 655 received in an end of first groove section 597 distant to second groove section 611 of limiting sleeve 593. Locking member 573 is in an unlocking position, with tail 591 of locking member 573 received in narrower portion 555 of channel 553 (FIGS. 6 and 7) and disengaged from restraining groove 377 of outer lining 353. In this case, each of grips 659 and 739 of inner and outer handles 657 and 737 is substantially in a horizontal state.

If inner handle 657 in FIGS. 6 and 7 pivots in the circumferential direction, inner spindle 76 also pivots in the circumferential direction by a wall of engagement slot 88, and lug 84 of inner spindle 76 presses against second push face 151B of retractor 131 and moves from the first position to a second position (FIG. 11) away from notches 119, moving latch 779 to the unlatching position. Furthermore, actuating block 86 of inner spindle 76 drives push ring 40A of inner returning device 38A to pivot when inner handle 657 pivots, causing movement of first tang 52A of torsion spring 50A. When inner handle 657 is released, first tang 52A of torsion spring 50A returns to its initial position and causes movement of push leg 46 of push ring 40A, which, in turn, returns inner spindle 76 to the horizontal state (FIG. 10). Latch 779 returns to the latching position (FIG. 6). When retractor 131 is in the second position, restraining arm 96 of restraining member 92 abuts one of stepped portions 70 of inner lining 60 (FIG. 11A), preventing further pivotal movement of inner handle 657 and, thus, preventing deformation of lug 84 of inner spindle 76 due to improper operation.

If outer handle 737 in FIGS. 6 and 7 pivots in the circumferential direction, outer spindle 379 also pivots in the circumferential direction by a wall of insertion slot 396 that pushes locking member 573 to pivot. Pivotal movement of tail 591 of locking member 573 causes pivotal movement of actuating cylinder 531 by pressing against a wall of narrower portion 555 of Channel 553. Tab 537 of actuating cylinder 531 presses against first push face 151A of retractor 131 and moves retractor 131 to the second position (FIG. 11), retracting latch 779 to the unlatching position. When retractor 131 is in the second position, tail 591 of locking member 573 abuts one of stepped portions 373 of outer lining 353 (FIG. 11B). Furthermore, actuating block 86 drives push ring 40B of outer returning device 38B to pivot when outer spindle 379 pivots, causing movement of first tang 52A of torsion spring 50B. When outer handle 737 is released, first tang 52A of torsion spring 50B returns to its initial position and causes movement of push leg 46 of push ring 40B, which, in turn, returns outer spindle 379 to the horizontal state. Latch 779 returns to the latching position (FIG. 6).

Figure 12:
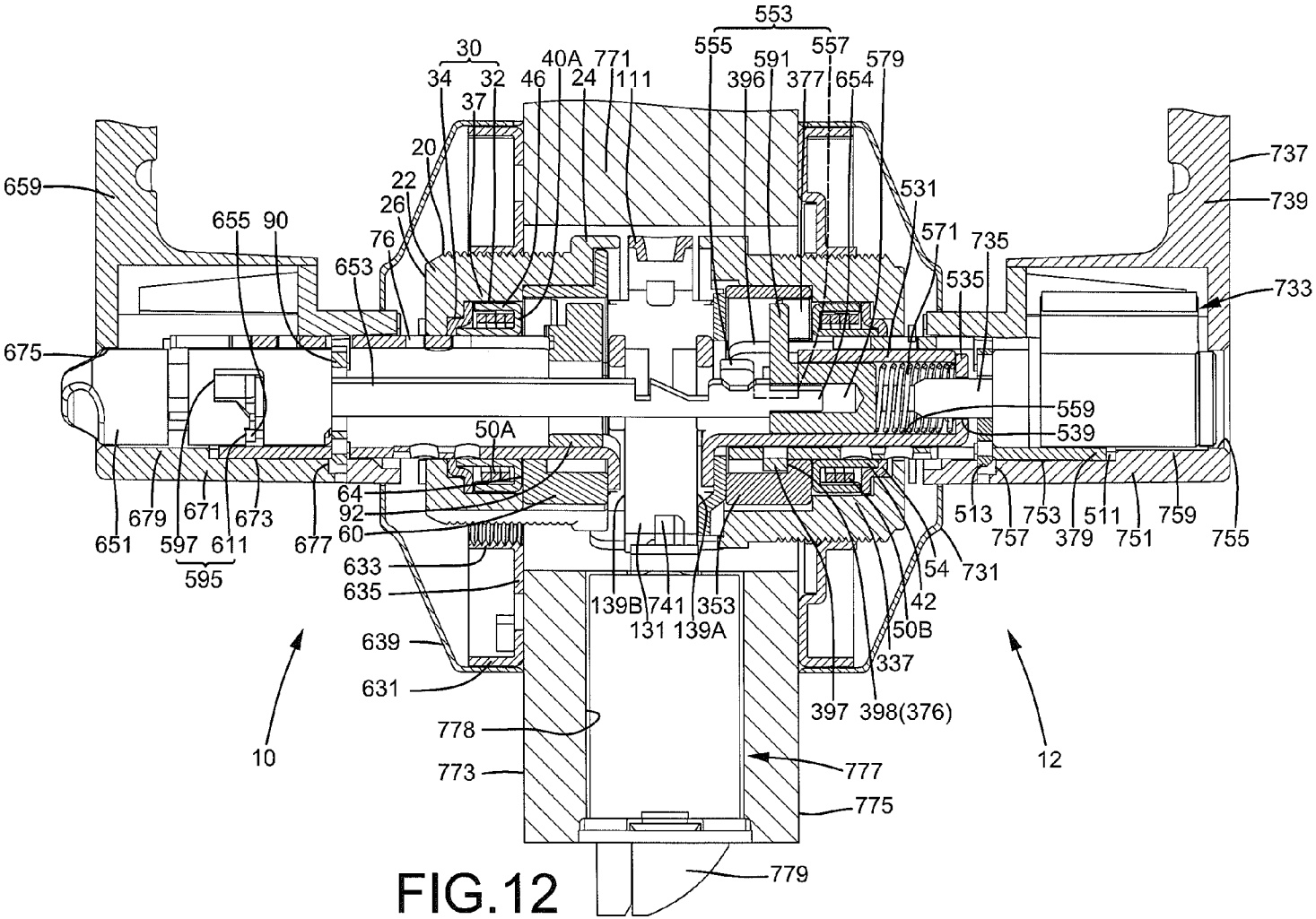
FIG. 12 shows a view similar to FIG. 6, with a knob pushed to move a locking block to a locking position.

When knob 651 is pushed toward lock core 733 in the longitudinal direction while the cylindrical lock is in a state shown in FIGS. 6 and 7, push rod 653 and engaging piece 655 move together with knob 651. Distal end 654 of push rod 653 pushes locking member 573 to move toward lock core 733 in the longitudinal direction and compresses spring 571 until tail 591 reaches a locking position in wider portion 557 of channel 553. Furthermore, a distal end of tail 591 engages restraining groove 377 of outer lining 353 (FIG. 12). Engaging piece 655 reaches an intersection of first and second groove sections 597 and 611 of limiting groove 595 of limiting sleeve 593. In this case, knob 651 can be pivoted in the circumferential direction to move engaging piece 655 to the other end of second groove section 611 distant to first groove section 597, such that knob 651, engaging piece 655, and push rod 653 can not move away from lock core 733 in the longitudinal direction. Thus, locking member 573 is retained in the locking position, and outer handle 737 can not be pivoted to move outer spindle 379. Specifically, tail 591 of locking member 573 is engaged in insertion slot 396 of outer spindle 379, preventing pivotal movement of outer spindle 379.

When it is desired to move locking member 573 to the unlocking position, knob 651 is pivoted in a reverse direction to move engaging piece 655 to the intersection between first and second groove sections 597 and 611 of limiting groove 595 of limiting sleeve 593, and locking member 573 is biased by spring 571 to move in the longitudinal direction from the locking position (FIG. 12) to the unlocking position (FIG. 6). Engaging piece 655 returns to the end of first groove section 597 of limiting sleeve 593 distant to second groove section 611. In this state, outer handle 737 can be operated to retract latch 779.

Figure 13:
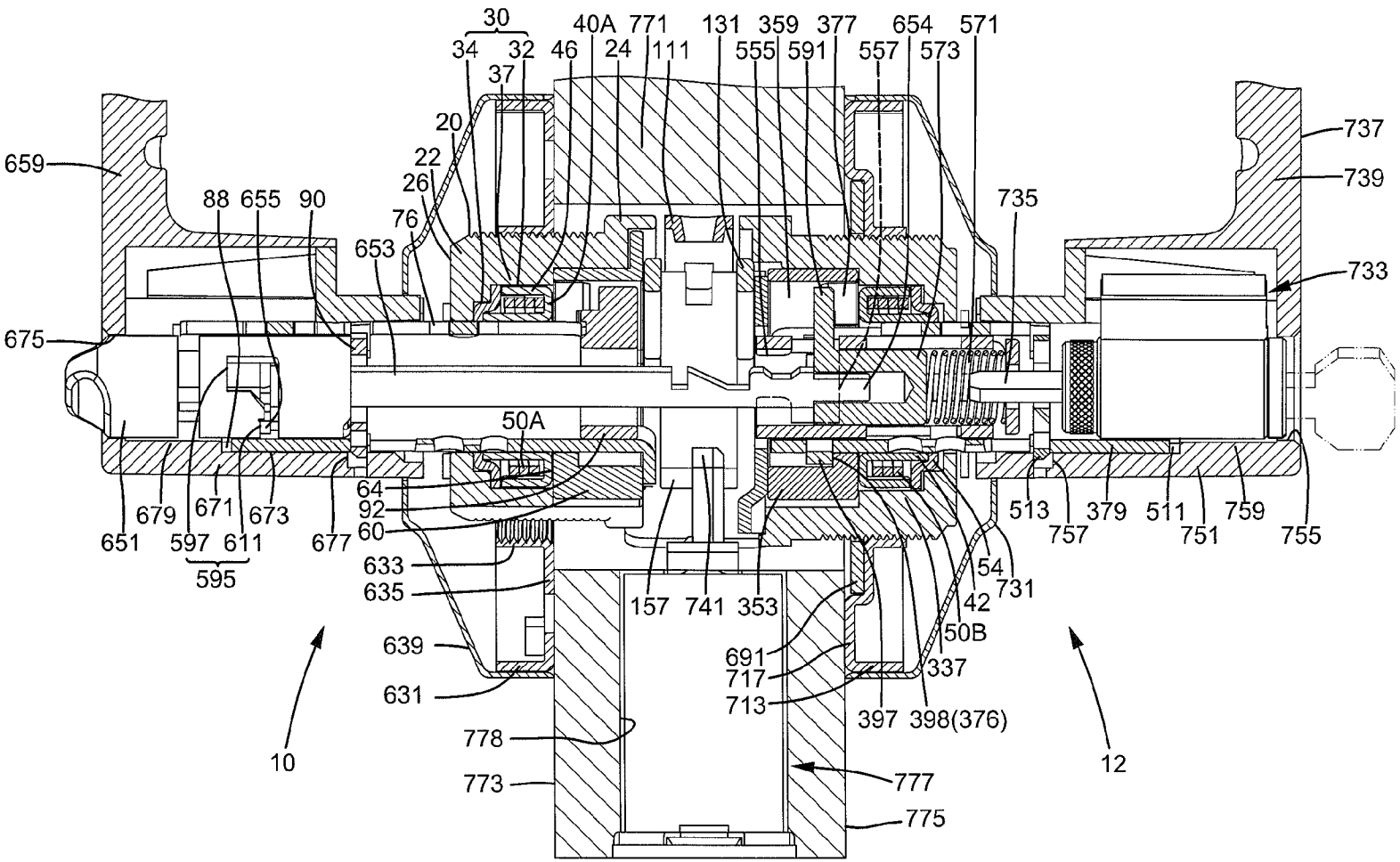
FIG. 13 shows a view similar to FIG. 12, with a lock core operated by a key to retract a latch.

When a key is pivoted to release the locking state of lock core 733 while the cylindrical lock is in a state shown in FIG. 12, tail piece 735 of lock core 733 pivots in the circumferential direction and presses against one of teeth 551 in actuating hole 539 of actuating cylinder 531, causing pivotal movement of actuating cylinder 531. During pivotal movement of actuating cylinder 531, tab 537 of actuating cylinder 531 moves retractor 131 to the second position and, thus, retracts latch 779 to the unlatching position (FIG. 13) without moving outer handle 737. This is because wider portion 557 of channel 553 provides a room for tail 591 of locking member 573 during pivotal movement of actuating cylinder 531. Furthermore, when locking member 573 is in the locking position, inner handle 657 can still be operated to retract latch 779 to the unlatching position.

Since push rings 40A and 40B, torsion springs 50A and 50B, and collar 54 of inner and outer returning devices 38A and 38B are assembled before mounting into inner and outer chassis 20 and 305, troublesome assembling procedures are avoided, effectively increasing the assembling efficiency of the cylindrical lock. Furthermore, inner and outer linings 60 and 353 in inner and outer chassis 20 and 305 are more rigid than inner and outer spindles 76 and 379 to avoid wear of inner and outer linings 60 and 353 as occurred in conventional cylindrical locks.

Outer spindle 379 is formed by bending a metal sheet having a thickness of about 2 mm. Specifically, the metal sheet is obtained by punching and includes restraining protrusions 397 after the punching procedure. Then, the metal sheet is bent to form outer spindle 379 with restraining protrusions 397, eliminating the time and costs for increasing the outer diameter of inner end 391. Furthermore, by directly forming restraining protrusions 397 before bending the metal sheet, the spacing between abutment surface 398 of each restraining protrusion 397 and end face of inner end 391 of outer spindle 379 can be controlled to be the same. Thus, outer spindle 379 can be mounted in a correct position relative to outer lining 353 and outer chassis 305 in the longitudinal direction, reducing the product defect rate resulting from second processing.

Since upper and lower compartments 171A and 171B of retractor 131 are reserved while forming retractor 131, drilling of retractor 131 to form pivot holes for receiving first and second pivots 193A and 193B is not required. Furthermore, the reserved locations of upper and lower compartments 171A and 171B are more precise, and upper and lower tongues 175A and 175B are bent after mounting first and second pivots 193A and 193B, retaining first and second pivots 193A and 193B easily while increasing reliability of mounting of first and second rollers 301A and 301B on retractor 131.

Now that the basic teachings of the present invention have been explained, many extensions and variations will be obvious to one having ordinary skill in the art. For example, although inner and outer returning devices 38A and 38B, outer spindle 379, and retractor 131 provide synergistic results, it can be appreciated that outer spindle 379 and retractor 131 can be of any desired form as conventional, including, but not limited to, of a commercially available type. Furthermore, inner lining 60 does not have to include extension 75 while allowing movement of retractor 131 between the first and second positions in the transverse direction between first side 62 of inner lining 60 and lid 515. Further, inner operational device 10 does not have to include restraining member 92. In this case, when inner handle 657 pivots to move retractor 131 to the second position, further pivotal movement of inner handle 657 is limited due to restriction to the further movement of retractor 131 in the transverse direction.

Furthermore, outer operational device 12 does not have to include lid 515 while allowing retractor 131 to be slideably engaged between the end face of inner end 28 of chassis 20 and the end face of inner end 311 of outer chassis 305. Push ring 40A of inner returning device 38A does not have to include flange 44, push leg 46 can directly extend in the longitudinal direction from an end of sleeve portion 42, and limiting plate 47 can extend in the longitudinal direction from an end of sleeve portion 42. In this case, torsion spring 50A can still abut connecting portions between sleeve portion 42 and each of push leg 46 and limiting plate 47. Likewise, push ring 40B of outer returning device 38B does not have to include flange 44, push leg 46 can directly extend in the longitudinal direction from an end of sleeve portion 42, and limiting plate 47 can extend in the longitudinal direction from an end of sleeve portion 42. In this case, torsion spring 50B can still abut connecting portions between sleeve portion 42 and each of push leg 46 and limiting plate 47.

Furthermore, outer spindle 379 can include only one restraining protrusion 397 having C-shaped cross sections and extending in the circumferential direction to increase the contact area of abutment surface 398 for supporting engagement of outer spindle 379 and outer lining 353 and permitting stable pivotal movement of outer spindle 379. Inner returning device 38A does not have to include collar 54, and torsion spring 50A can directly abut a wall of second chamber 34 of inner chassis 20. Likewise, outer returning device 38B does not have to include collar 54, and torsion spring 50B can directly abut a wall of second compartment 333 of outer chassis 305.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A cylindrical lock comprising, in combination:

an inner chassis including inner and outer ends spaced in a longitudinal direction, with the inner chassis further including a space extending from the inner end of the inner chassis toward but spaced from the outer end of the inner chassis, with a rib formed on an inner periphery of the space, with the inner chassis further including an axial hole extending from the outer end of the inner chassis to the space, with the inner chassis adapted to be mounted in a first mounting hole of a door, with the door having inner and outer sides spaced in the longitudinal direction;

an inner locking ring mounted around the inner chassis, with the inner locking ring adapted to abut the inner side of the door;

a first push ring pivotably received in the space of the inner chassis and adjacent to the outer end of the inner chassis, with the first push ring including a sleeve portion having first and second ends spaced in the longitudinal direction, with an actuating groove defined in an outer periphery of the sleeve portion of the first push ring, with a first push leg extending from one of the first and second ends of the sleeve portion of the first push ring, with the first push leg spaced from the outer periphery of the sleeve portion of the first push ring in a radial direction perpendicular to the longitudinal direction;

a first torsion spring mounted around the sleeve portion of the first push ring, with the first torsion spring including first and second tangs abutting two sides of the first push leg of the first push ring, with the rib of the inner chassis located between the first and second tangs of the first torsion spring, wherein when the first push ring pivots in the circumferential direction, the first push leg pivots the first tang of the first push ring, and the second tang of the first push ring is retained on the rib of the inner chassis;

an inner lining mounted in the space of the inner chassis and made of a material having a hardness of HRB80-HRB100, with the inner lining including first and second sides spaced in the longitudinal direction, with a pivot hole defined in the second side of the inner lining and aligned with the axial hole of the inner chassis, with the second side of the inner lining abutting the push ring;

an inner spindle pivotably received in the axial hole of the inner chassis, with the inner spindle made of a material having a hardness of HRC35-HRC50, with the inner spindle including an inner end located in the inner chassis and an outer end located outside of the inner chassis, with the inner spindle further including an outer periphery extending between the inner and outer ends of the inner spindle, with a lug formed on the inner end of the inner spindle and protruding radially outward away from the outer periphery of the inner spindle, with an actuating block protruding outward from the outer periphery of the inner spindle and located adjacent to the inner end of the inner spindle, with a portion of the inner spindle adjacent to the inner end being pivotably received in the pivot hole of the inner lining, with the lug located outside of the first side of the inner lining, with the outer end of the inner spindle located outside of the outer end of the inner chassis, with the actuating block of the inner spindle engaged with the actuating groove of the first push ring;

an inner handle mounted to the outer end of the inner spindle and located beyond the outer end of the inner chassis, with the inner spindle and the push ring pivoting together with the inner handle in a circumferential direction about the longitudinal direction when the inner handle pivots in the circumferential direction;

an outer chassis including inner and outer ends spaced in the longitudinal direction, with the outer chassis further including a space extending from the inner end of the outer chassis toward but spaced from the outer end of the outer chassis, with a rib formed on an inner periphery of the space of the outer chassis, with the outer chassis further including an axial hole extending from the outer end of the outer chassis to the space of the outer chassis, with the outer chassis adapted to be mounted in the first mounting hole of the door, with two engagement arms extending from the inner end of the outer chassis and fixed to the inner chassis, with the inner end of the inner chassis spaced from the inner end of the outer chassis;

an outer locking ring mounted around the outer chassis, with the outer locking ring adapted to abut the outer side of the door;

a second push ring pivotably received in the space of the outer chassis and adjacent to the outer end of the outer chassis, with the second push ring including a sleeve portion having first and second ends spaced in the longitudinal direction, with an actuating groove defined in an outer periphery of the sleeve portion of the second push ring, with a second push leg extending from one of the first and second ends of the sleeve portion of the second push ring, with the second push leg spaced from the outer periphery of the sleeve portion of the second push ring in a radial direction perpendicular to the longitudinal direction;

a second torsion spring mounted around the sleeve portion of the second push ring, with the second torsion spring including first and second tangs abutting two sides of the second push leg, with the rib of the outer chassis located between the first and second tangs of the second torsion spring, wherein when the second push ring pivots in the circumferential direction, the second push leg pivots the first tang of the second push ring, and the second tang of the second push ring is retained on the rib of the outer chassis;

an outer lining mounted in the space of the outer chassis, with the outer lining made of a material having a hardness of HRB80-HRB100, with the outer lining including first and second sides spaced in the longitudinal direction, with a pivot hole defined in the second side of the outer lining and aligned with the axial hole of the outer chassis, with the second side of the outer lining abutting one of the first and second ends of the second push ring;

an outer spindle pivotably received in the outer chassis, with the outer spindle made of a material having a hardness of HRC35-HRC50, with the outer spindle including an inner end and an outer end, with the outer spindle further including an outer periphery extending between the inner and outer ends of the outer spindle, with an actuating block protruding outward from the outer periphery of the outer spindle, with the outer spindle including a receiving space extending from the inner end of the outer spindle through the outer end of the outer spindle, with the inner end of the outer spindle pivotably received in the pivot hole of the outer lining, with the outer end of the outer spindle located outside of the outer end of the outer chassis, with the actuating block of the outer spindle engaged with the actuating groove of the second push ring;

an outer handle mounted to the outer end of the outer spindle and located beyond the outer end of the outer chassis, with the outer spindle and the push ring pivoting together with the outer handle in the circumferential direction when the outer handle pivots in the circumferential direction;

an actuating cylinder received in the receiving space of the outer spindle, with the actuating cylinder including a tab, with the actuating cylinder pivoting together with the outer handle when the outer handle pivots in the circumferential direction; and a retractor including two lateral surfaces defining first and second push faces, respectively, with the retractor slideably received between the inner end of the inner chassis and the inner end of the outer chassis, with the lug of the inner spindle abutting the second push face, with the tab of the actuating cylinder abutting the first push face, with the retractor adapted to be connected to a drawing member of a latch device mounted in a second mounting hole of the door in communication with the first mounting hole, with the latch device including a latch movable between a latching position in the door and an unlatching position outside of the door, with the retractor movable between a first position in which the latch is in the latching position and a second position in which the latch is in the unlatching position;

wherein when the inner handle pivots in the circumferential direction, the lug of the inner spindle presses against the second push face of the retractor, moving the retractor from the first position to the second position, and wherein when the outer handle pivots in the circumferential direction, the outer spindle and the actuating cylinder pivot in the circumferential direction, and the tab of the actuating cylinder presses against the first push face of the retractor, moving the retractor from the first position to the second position.

2. The cylindrical lock as claimed in claim 1, with a receiving compartment extending from the first side toward but spaced from the second side of the outer lining, with the pivot hole defined in the second side of the outer lining and extending to the receiving compartment, with the receiving compartment including an inner periphery having a movement groove, with the movement groove including two stepped portions spaced in the circumferential direction, with a restraining groove extending radially outward from an inner periphery of the pivot hole of the outer lining, with the restraining groove extending from the second side of the outer lining to the movement groove, with the actuating cylinder including first and second ends spaced in the longitudinal direction, with a receptacle extending from the first end of the actuating cylinder toward but spaced from the second end of the actuating cylinder, with a channel formed in the first end of the actuating cylinder and in communication with the receptacle, with the channel including a narrower section extending from an end face of the first end of the actuating cylinder toward but spaced from the second end of the actuating cylinder, with the channel further including a wider section extending in the circumferential direction and intersecting an end of the narrower section distant to the first end of the actuating cylinder, with an insertion slot extending from the inner end of the outer spindle toward but spaced from the outer end of the outer spindle, with the cylindrical lock further comprising:

a locking member pivotably received in the receptacle of the actuating cylinder, with the locking member including a cylindrical portion, with a tail formed on an outer periphery of the cylindrical portion, with the tail extending radially through the channel of the actuating cylinder and the insertion slot of the outer spindle into the movement groove of the outer lining, with the locking member movable in the longitudinal direction between an unlocking position in which the tail is received in the narrower portion of the channel and a locking position in which the tail is received in the wider portion of the channel;

a knob received in the inner handle, with the knob manually movable relative to the inner handle in the longitudinal direction; and a push rod having an end fixed to the knob, with the push rod including a distal end abutting the locking member, with the knob manually operable to move the locking member between the locking and unlocking positions, wherein when the locking member is in the unlocking position, the tail is disengaged from the restraining groove of the outer lining, the tail is pivoted by a wall of the insertion slot of the outer spindle if the outer handle is pivoted, and the tail pushes a wall of the narrower portion of the channel of the actuating cylinder, causing the tab of the actuating cylinder to move the retractor from the first position to the second position, and wherein when the locking member is in the locking position, the tail is engaged in the restraining groove of the outer lining, preventing pivotal movement of the outer spindle.

3. The cylindrical lock as claimed in claim 2, with a restraining protrusion protruding outward from the outer periphery of the outer spindle, with the restraining protrusion including an abutment surface facing the outer end of the outer spindle, with an abutment face formed in an intersection between the receiving compartment and the pivot hole of the outer lining, with the abutment surface of the restraining protrusion abutting the abutment face of the outer lining, avoiding movement of the outer spindle away from the inner end of the outer chassis in the longitudinal direction.

4. The cylindrical lock as claimed in claim 1, with the retractor including front and rear ends spaced in the longitudinal direction, with the two lateral surfaces extending between the front and rear ends, with the retractor further including upper and lower surfaces spaced in a vertical direction perpendicular to the longitudinal direction and extending between the front and rear ends and extending between the two lateral surfaces, with an upper recess defined in the upper surface, with a lower recess defined in the lower surface, with each of the upper and lower recesses having two sidewalls, with two upper compartments defined in the two sidewalls of the upper recess and extending to the two lateral surfaces, forming two upper tongues spaced in the longitudinal direction, with two lower compartments defined in the two sidewalls of the lower recess and extending to the two lateral surfaces, forming two lower tongues spaced in the longitudinal direction, with each of the two upper compartments and the two lower compartments including an opening and an end wall connected to one of the two upper tongues and the two lower tongues, with the cylindrical lock further comprising:

a first roller including a pivot hole, with the first roller received in the upper recess and partially extending beyond the upper surface of the retractor;

a second roller including a pivot hole, with the second roller received in the lower recess and partially extending beyond the lower surface of the retractor;

a first pivot rotatably mounted to the first roller, with the first pivot including two engagement sections spaced in the longitudinal direction and a pivotal section, with the pivotal section of the first pivot received in the pivot hole of the first roller, with the two engagement sections of the first pivot engaged in the two upper compartments and abutting the end walls of the two upper compartments, with the opening of each of the two upper compartments being smaller than each of the two engagement sections of the first pivot;

a second pivot rotatably mounted to the second roller, with the second pivot including two engagement sections spaced in the longitudinal direction and a pivotal section, with the pivotal section of the second pivot received in the pivot hole of the second roller, with the two engagement sections of the second pivot engaged in the two lower compartments and abutting the end walls of the two lower compartments, with the opening of each of the two lower compartments being smaller than each of the two engagement sections of the second pivot; and a jacket mounted around the retractor, with the jacket including upper and lower walls spaced in the vertical direction and an intermediate wall extending between the upper and lower walls, with each of the upper and lower walls including an end distant to the intermediate wall and having a notch, with the jacket fixed between the inner end of the inner chassis and the inner end of the outer chassis, with the front end of the retractor facing the notches of the jacket, with the rear end of the retractor facing the intermediate wall, with the first and second rollers rollably abutting the upper and lower walls of the jacket, respectively, allowing the retractor to slide relative to the jacket between the first position adjacent to the notches and the second position away from the notches, moving the latch between the latching position and the unlatching position.

5. The cylindrical lock as claimed in claim 4, with each of the two engagement sections of the first pivot having a diameter smaller than a diameter of the pivotal section of the first pivot, with each of the two engagement sections of the second pivot having a diameter smaller than a diameter of the pivotal section of the second pivot.

6. The cylindrical lock as claimed in claim 4, with the pivotal section of the first pivot having a length in the longitudinal direction slightly smaller than a spacing between the two upper compartments in the longitudinal direction, with the pivotal section of the second pivot having a length in the longitudinal direction slightly smaller than a spacing between the two lower compartments in the longitudinal direction.

* * * * *